US009938723B2

(12) United States Patent
Shargani

(10) Patent No.: US 9,938,723 B2
(45) **Date of Patent: *Apr. 10, 2018**

(54) CANOPY SYSTEM

(71) Applicant: Afshin Shargani, Los Angeles, CA (US)

(72) Inventor: Afshin Shargani, Los Angeles, CA (US)

(73) Assignee: Infinity Canopy, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/612,916

(22) Filed: Jun. 2, 2017

(65) Prior Publication Data

US 2017/0328068 A1 Nov. 16, 2017

Related U.S. Application Data

(63) Continuation-in-part of application No. 15/263,308, filed on Sep. 12, 2016, now Pat. No. 9,745,755, which
(Continued)

(51) Int. Cl.
*E04H 15/58* (2006.01)
*E04H 15/04* (2006.01)
(Continued)

(52) U.S. Cl.
CPC ..... *E04F 10/02* (2013.01); *E04F 10/0607* (2013.01); *E04F 10/0633* (2013.01);
(Continued)

(58) Field of Classification Search
CPC .... E06B 2009/2625; E06B 9/24; E06B 9/262; E06B 2009/247; E04H 15/04;
(Continued)

(56) References Cited

U.S. PATENT DOCUMENTS 301,923 A * 7/1884 Reisdorf ..... B61B 12/005 104/113
1,084,695 A * 1/1914 Ooghlin ..... F16G 11/00 24/115 R
(Continued)

FOREIGN PATENT DOCUMENTS

CH 669435 A * 3/1989
DE 3727292 A1 * 1/1988 ..... A01G 9/22
(Continued)

*Primary Examiner* — Robert Canfield
(74) *Attorney, Agent, or Firm* — Payam Moradian

(57) ABSTRACT

There is described a canopy system comprising two or more parallel elongated rods, one or more canopy pieces having two parallel edges, two or more elongated bars connected to each of the two or more parallel elongated rods and attached to each of the two parallel edges of the one or more canopy pieces, and at least one connection mechanism attached to each of the elongated rods having a connector that is capable of being suspended from a support. The elongated rods may include at least one lower cavity having two channels each configured to detachably and slidably receive each of the elongated bars. The lower cavity may have a groove that is configured to detachably and slidably receive an accessory. The elongated rods each may include at least one upper cavity configured to detachably and slidably receive each connection mechanism and a second accessory.

20 Claims, 32 Drawing Sheets

Related U.S. Application Data is a continuation of application No. 15/000,307, filed on Jan. 19, 2016, now Pat. No. 9,470,012, and a continuation-in-part of application No. 14/448,825, filed on Jul. 31, 2014, now Pat. No. 9,255,441.

(60) Provisional application No. 62/240,353, filed on Oct. 12, 2015, provisional application No. 61/874,623, filed on Sep. 6, 2013.

(51) Int. Cl.

| | |
|---|---|
| ***E04F 10/06*** | (2006.01) |
| ***E06B 9/262*** | (2006.01) |
| ***E04H 15/64*** | (2006.01) |
| ***E04F 10/02*** | (2006.01) |
| ***E04H 15/54*** | (2006.01) |

(52) U.S. Cl.

CPC ..... *E04F 10/0666* (2013.01); *E04H 15/04* (2013.01); *E04H 15/54* (2013.01); *E04H 15/58* (2013.01); *E04H 15/64* (2013.01); *E04H 15/642* (2013.01); *E06B 9/262* (2013.01); *E06B 2009/2625* (2013.01)

(58) Field of Classification Search

CPC ..... E04H 15/34; E04H 15/42; E04H 15/00; E04H 15/642; E04H 15/10; G09F 2007/186; A01G 9/22; E04F 10/02; E04F 10/04; E04F 10/0607; E04F 10/0633; E04F 10/0666; E04F 10/0659

USPC ..... 47/17, 22.1; 135/90, 91; 52/39, 63, 64, 52/DIG. 4, 148; 160/84.01, 84.06, 127, 160/46; 411/104; 248/322, 339, 317, 248/340; 256/42; 24/115 K, 115 L

See application file for complete search history.

(56) References Cited

U.S. PATENT DOCUMENTS 1,373,223 A * 3/1921 Chance ..... E02D 5/80 24/115 K
1,521,987 A * 1/1925 Belfranci ..... D06F 57/00 211/119.12
1,728,074 A * 9/1929 Nicholas ..... A47H 5/032 160/84.06
1,899,062 A * 2/1933 Steffen ..... E06B 9/28 160/193
1,985,509 A * 12/1934 Lemont ..... F16G 11/00 198/842
3,288,159 A * 11/1966 Corliss ..... E04H 9/14 135/118
3,481,073 A * 12/1969 Yoshida ..... A01G 9/22 135/120.2
4,091,857 A * 5/1978 Jacobs ..... A47H 1/18 160/330
4,095,639 A * 6/1978 Ryan ..... A01G 9/225 160/84.02
4,375,232 A * 3/1983 Heescher ..... A01G 9/22 160/84.06
4,683,933 A * 8/1987 Dunbar ..... E06B 9/0692 160/273.1
5,265,373 A * 11/1993 Vollebregt ..... A01G 9/22 160/84.01
6,257,300 B1 * 7/2001 Brownlie ..... A47H 23/00 160/264
6,305,109 B1 * 10/2001 Lee ..... G02B 6/0068 40/546
6,488,118 B1 * 12/2002 Corriveau ..... A62B 35/0056 104/111
6,766,849 B1 * 7/2004 Tseng ..... A47H 1/19 160/332
D630,288 S * 1/2011 Grazioso ..... D21/837
9,255,441 B2 * 2/2016 Shargani ..... E04H 15/58
9,624,689 B2 * 4/2017 Bailey ..... E04H 15/32
9,644,389 B2 * 5/2017 Xie ..... E04H 15/34
2004/0020402 A1 * 2/2004 Petzl ..... A63G 21/22 105/150
2008/0142064 A1 * 6/2008 Maraki ..... E04F 10/0607 135/121
2008/0202007 A1 * 8/2008 Suciu ..... G09F 3/20 40/658
2009/0031641 A1 * 2/2009 Grazioso ..... E04F 10/02 52/74
2010/0252207 A1 * 10/2010 Westgarth ..... E04F 10/02 160/45
2011/0265260 A1 * 11/2011 Darrow ..... A61G 7/1015 5/85.1
2013/0167749 A1 * 7/2013 Spies ..... B66C 7/02 104/93
2014/0034099 A1 * 2/2014 Wang ..... B60J 11/04 135/88.01
2015/0233116 A1 * 8/2015 Mayer ..... E04B 9/04 52/506.05
2017/0037635 A1 * 2/2017 Shargani ..... E04F 10/02

FOREIGN PATENT DOCUMENTS

JP 06193365 A * 7/1994
JP 2005213997 A * 8/2005

* cited by examiner

CANOPY SYSTEM

CROSS-REFERENCE

The present application is a continuation-in-part (CIP) of U.S. application Ser. No. 15/263,308, filed on Sep. 12, 2016, which is a continuation of U.S. application Ser. No. 15/000,307, filed on Jan. 19, 2016, which is a continuation-in-part (CIP) of U.S. application Ser. No. 14/448,825, filed on Jul. 31, 2014, which claims the priority of provisional application No. 61/874,623, filed on Sep. 6, 2012. The present application also claims the benefit of provisional application No. 62/240,353, filed on Oct. 12, 2015. All of these applications are incorporated herein by reference in their entirety.

FIELD OF THE INVENTION

The invention is generally directed to a structural assembly, more particularly to a canopy system used to protect against sunlight, rain, wind, snow, and the like.

BACKGROUND OF THE INVENTION

Canopies and awnings have been widely used to provide shade and shelter from sunlight, rain, wind, snow or other weather conditions. Typically, canopies or awnings are attached to a building for support, and often use support posts to hold the fabric pieces upright. However, many canopy systems are custom made to meet various design needs, thus adding expense. There is a need for an inexpensive canopy system that possesses advantages of using readily available components to allow for inexpensive setup and use. It is an object of the present invention to meet this need.

SUMMARY OF THE INVENTION

Provided is a canopy system comprising: a. two parallel elongated rods; b. a canopy piece having two parallel edges; c. an elongated bar attached to each of the two parallel edges of the canopy piece; and; d. a connection mechanism attached to each of the elongated rods, each of the connection mechanisms having a connector, each of the connectors capable of being suspended from a support. The canopy system can comprise: a. one or more additional elongated rods; b. one or more additional canopy pieces each having two parallel edges; c. additional elongated bars attached to each of the parallel edges of the additional canopy pieces; and d. additional connection mechanisms attached to each of the additional elongated rods, each of the additional connection mechanisms having an additional connector, each of the additional connectors capable of being suspended from the support; wherein each of the additional elongated bars is held by each of the additional elongated rods. The elongated bars can be tubular. The support can be a cable wire. The additional supports can be connectors capable of being suspended. The connectors can be capable of being movably suspended from the support. Each of the elongated rods can include an endcap. An accessory can be held by the rod. The accessory can be one or more lights. Each of the elongated rods can include at least one lower cavity and at least one upper cavity. The lower cavity can include one or more channels each configured to hold the elongated bars. The channels can be tubular. The lower cavity can include one or more channels each configured to hold the elongated bars, the lower cavity having a groove that opens into each of the channels such that the canopy pieces connected to the elongated bars held by the channels may exit the elongated rod through the groove. The upper cavity can include an upper track and a lower track, the upper track and lower track running substantially along the elongated rod, the upper cavity configured to hold the connection mechanisms. Each of the connection mechanisms can be fastened from outside the upper cavity. Each accessory can be attached to one or more of the lower or the upper cavity. A distance control thread can be attached to the elongated rods. Each of the connection mechanisms can include a base having a horizontal bar with one or more threaded holes. The elongated rods can be connected lengthwise, thereby changing the length of the canopy system. The elongated rods can be connected lengthwise through a horizontal bar that overlaps with two elongated rods that are aligned end to end. A supporting frame can be used having at least one supporting post, the supporting post attached to and supporting one or more beams, the support attached to, and supported by the one or more beams. A motor and a pulley can be used, the motor and pulley configured to switch the canopy system between a closed position and an open position. A free standing unit can be used having a supporting base and at least one supporting post, the supporting post having a lower end that is attached to the supporting base, the supporting post having an upper end that is attached to one or more beams, the support attached to and supported by the one or more beams. Two canopy pieces can be used. Each of the connection mechanisms can include a base having a horizontal bar with one or more threaded holes, the base attached to the connector, the horizontal bar of each of the connection mechanisms capable of being slidably inserted into the lower track, the threaded fasteners projecting into the upper track, the connection mechanisms capable of being fastened from outside the upper cavity.

Provided is an elongated rod comprising: a. a lower cavity with one or more channels; and b. an upper cavity. The lower cavity can include a groove. The upper cavity can have an upper track and a lower track, the upper track and lower track running substantially along the elongated rod. The lower cavity can include a groove having an opening into one or more channels. The elongated rod can comprise: a) a lower cavity with a groove and one or more channels, with the groove having an opening in a transverse direction both to the channels and to outside of the elongated rod; and b) an upper cavity. The upper cavity can have an upper track and a lower track, the upper track and lower track running substantially along the elongated rod.

Provided is a canopy component comprising: a. a canopy piece having two parallel edges; and b. an elongated bar attached to each of the parallel edges of the canopy piece.

Provided is a canopy system comprising: a. a first and a second elongated rod, the first and the second elongated rod each having a track and positioned parallel to each other; b. a canopy piece having a first and a second parallel edge; c. a first and a second elongated bar, the first elongated bar attached to the first parallel edge of the canopy piece, and the second elongated bar attached to the second parallel edge of the canopy piece, the first and the second elongated bar configured to be held by the first and the second the elongated rod respectively; and d. at least a first and a second connection mechanism, with at least one connection mechanism attached to the track of each of the first and the second elongated rod, each of the first and the second connection mechanism having a connector, the connector capable of being suspended from a support and to connect the canopy system to the support, said first and said second connection mechanism further configured to slide along the track and detachably fastened at any location along the track of the first and the second elongated rod, the first and the second connection mechanism configured to be fastened to the track of the first and the second elongated rod from a top of the first and the second elongated rod, wherein the connection mechanism can slide along the track and be fastened to different positions on the track.

Provided is a canopy system comprising: a) a first and a second elongated rod, the first and the second elongated rod positioned parallel to each other; b) a canopy piece having a first and a second parallel edge; c) a first and a second elongated bar, the first elongated bar attached to the first parallel edge of the canopy piece, and the second elongated bar attached to the second parallel edge of the canopy piece, the first and the second elongated bar configured to be held by the first and the second the elongated rod respectively; and d) at least, a first and a second connection mechanism, with at least one connection mechanism each slidably attached to the first and the second elongated rod, each of the first and the second connection mechanism having a connector, the connector capable of being suspended from a support and to connect the canopy system to the support, said first and said second connection mechanism further configured to slide along the elongated rod and detachably fastened at any location along the first and the second elongated rod, the first and the second connection mechanism configured to be fastened to the first and the second elongated rod. The first and second elongated rods each can have a track on outside of the elongated rods, the connection mechanism configured to slide on the outside track. The connection mechanism can be configured to be fastened to the track from outside of the first and the second elongated rod. The tracks can be on each side of the first and second elongated rod. The connection mechanism can comprise: a) the connector extending upward in a vertical direction from the elongated rod; b) an external slide, the external slide attached to the connector and riding on top of the elongated rod; c) one or more sliders attached to the external slide; wherein the connector supports the canopy system from the support, and the connector is configured to be moved to any position of the elongated rod by moving the external slide along the elongated rod though the sliders sliding through one or more tracks on the first and the second elongated rod. The connector can be rotatably attached to the external slide, allowing the support to run 360 degrees in relation to the first and the second elongated rod in a same plane. The canopy system can comprise: a) one or more additional elongated rods: b) one or more additional canopy pieces each having two parallel edges; c) additional elongated bars attached to each of the parallel edges of the additional canopy pieces; and d) additional connection mechanisms attached to each of the additional elongated rods, each of the additional connection mechanisms having an additional connector, each, of the additional connectors capable of being suspended from the support; wherein each of the additional elongated bars is held by each of the additional elongated rods. The first or the second elongated rod can comprise one or more channels, each channel configured to hold the elongated bars, the first or the second elongated rod further comprising a groove that opens into each of the channels such that the canopy pieces connected to the elongated bars held by the channels can exit the elongated rod through the groove.

Provided is a canopy system comprising: a. a first and a second elongated rod, the first and the second elongated rod positioned parallel to each other; b. a canopy piece having a first and a second parallel edge; c. a first and a second elongated bar, the first elongated bar attached to the first parallel edge of the canopy piece, and the second elongated bar attached to the second parallel edge of the canopy piece, the first and the second elongated bar configured to be held by the first and the second the elongated rod respectively; and d. a magnet assembly, the magnet assembly having a magnet, the magnet assembly attached to the first or the second elongated rod, the magnet of the magnet assembly configured to form a magnetic connection with an external support structure to maintain the canopy system in a deployed position. The magnet can be threadably attached to the elongated rod, the threadable attachment configured to allow the magnet's position to be adjusted in relation to the support structure. A cap can isolate the magnet from exposure to air. The canopy system can further comprise a handle. The handle can be attached to the elongated rod from top of the elongated rod with fasteners, the handle further extending below the elongated rod. A mounting member can be attached to the elongated rod, the mounting member having a threaded loop for receiving a magnet adjusting threaded member of the magnet assembly. The handle can be attached from top of the elongated rod, the handle having an opening configured to allow the threaded loop to rise above the handle from inside of the elongated rod.

Provided is a canopy system comprising: a) first and a second elongated rod, the first and the second elongated rod positioned parallel to each other; b) a canopy piece having a first and a second parallel edge; c) a first and a second elongated bar, the first elongated bar attached to the first parallel edge of the canopy piece, and the second elongated bar attached to the second parallel edge of the canopy piece, the first and the second elongated bar configured to be held by the first and the second the elongated rod respectively; and one or more of: i) a distance control thread attached to the first and the second elongated rod in a perpendicular direction, the distance control thread attached from the top by a fastener that travels inside of the rod; ii) two or more roller tracks attached in a perpendicular direction to the first and the second elongated rod, the first and the second elongated rod configured to be suspended from the track and slide along the track, the tracks attached to a support structure at each end of the tracks; iii) at least a first and a second connection mechanism, with at least one connection mechanism attached in a horizontal direction to end of the first and the second elongated rod, each of the first and the second connection mechanism having a connector, the connector configured to attached to a support and to connect the canopy system to the support. The first and second elongated rod can have a track, the track configured to have a bar that slides along the track, wherein a single fastener fastens both the bar and the distance control thread to the track. Each elongated rod can have two connection mechanisms, with one of the two connection mechanisms attached at each end of the rod. The connection mechanism can be parallel to the elongated rod in the horizontal plane. The tracks can have a roller carriage with a mounting member extending below the track, the mounting member having a loop configured for connection to the elongated rod.

DETAILED DESCRIPTION OF THE INVENTION

The present invention provides a canopy system that is easy to install, repair, is highly adjustable, and can be made from mass produced parts that a user can purchase at a store at relatively reasonable prices. The canopy system is expandable both in length and width. The canopy system can easily be repaired by replacing any damaged parts. The canopy system can be used in any environment that allows for hanging the canopy system from a support. The installation of the canopy system is very simple and eliminates the need to have a highly skilled laborer for installation. The canopy system can also be adjusted to hang from as little as one support to a plurality support depending on the weight of the canopy system.

Figure 1B:
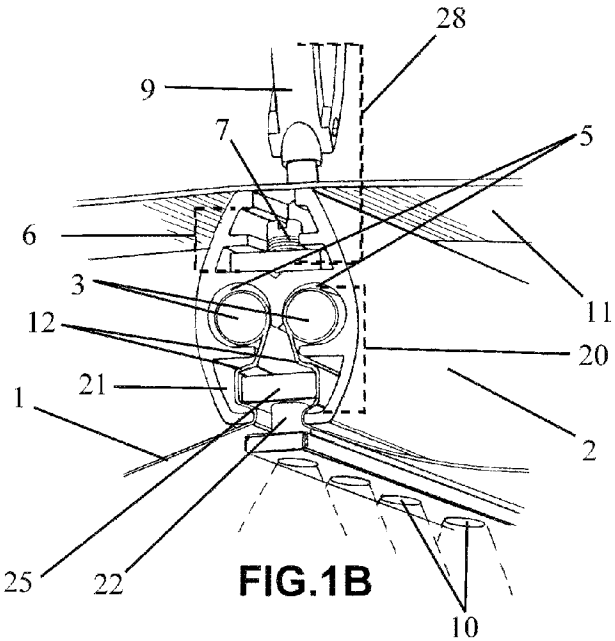
FIG. 1B is a cross-sectional view of the elongated rod in FIG. 1A.
Figure 1A:
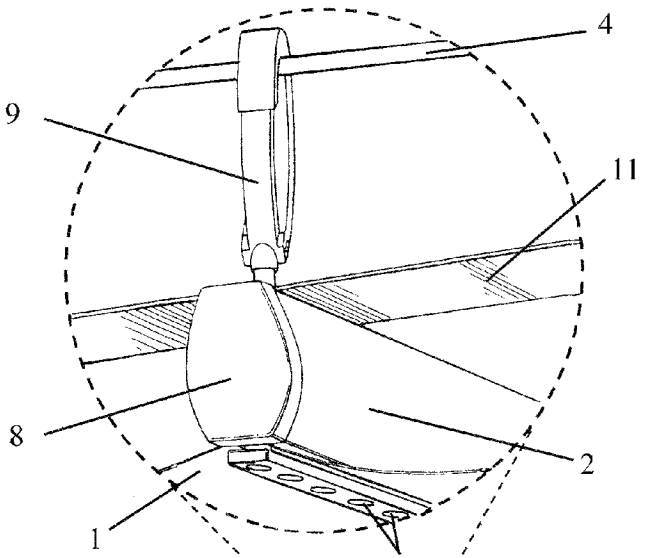
FIG. 1A is a perspective view of an embodiment of the present invention including a close-up view of the elongated rod and connector of the canopy system.
Figure 1A:
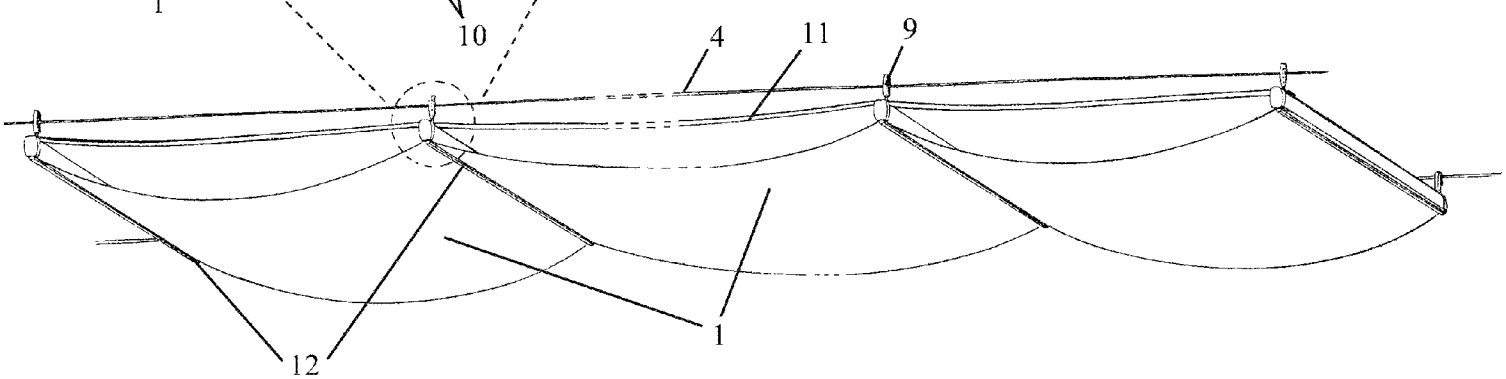

FIG. 1A illustrates a canopy system according to one embodiment of the present invention. The canopy system that is illustrated works in a horizontal fashion. There is described one or more canopy pieces 1, each having two substantially parallel edges 12. Each canopy piece 1 can be connected to two or more elongated rods 2. Elongated bars 3 can be connected to the parallel edges 12 of the canopy piece 1. For example, the opposite parallel edges 12 of canopy piece 1 can be rolled up and attached to the elongated bars 3. The edges 12 can be sewn, glued, stapled, riveted, or attached with other mechanisms. The elongated bars 3 can be of various shapes, including tubular (circular), rectangular, triangular, and elliptical. The elongated bars can also be of various materials, including plastic, and metal, such as a one piece fabricated aluminum. The elongated bars 3 can be held by each elongated rod 2, thus holding each canopy piece 1 in place between two separate elongated rods 2 of the canopy system. The canopy system itself is supported by one or more supports 4, such as cable wires. The canopy system can be used with as many wires that are needed depending on the weight of the canopy system. For a large canopy system, a user may desire to run multiple wires and use multiple connection mechanisms. In some embodiments, as shown in FIG. 1B, the elongated bars 3 can be held by being inserted into the elongated rods 2. In other embodiments, the elongated bars 3 can be held by being externally attached (e.g. FIG. 11*b*) to the elongated rods 2 through external channels, rings, hoops or other external devices without need for internal cavities in elongated rods 2.

FIG. 1B shows a cross-sectional view describing the detail inside of each elongated rod 2 and the connection established. Each elongated rod 2 can have at least one lower cavity 20. In this embodiment, the lower cavity 20 can hold the elongated bars 3 that are connected to the canopy pieces 1. In another embodiment, there can be one or more channels 5 in the lower cavity 20 which can hold the elongated bars 3. In one embodiment, the channels 5 can be used to detachably and slidably receive the elongated bars 3. The channels may have a cross-section of various shapes, including tubular (circular), rectangular, elliptical, and triangular, so that they can hold elongated bars 3 of a corresponding shape. For example, the lower cavity 20 can have two tubular channels 5 as shown in FIG. 1B to hold two tubular elongated bars 3. Alternatively, for example, the lower cavity 20 can have four tubular channels 5. Any number of channels 5 can be used.

The lower cavity 20 can contain a groove 21 having an opening into each channel 5. These channels 5 can be configured to hold the elongated bars 3, the canopy pieces 1 being connected to the elongated bars 3 through the opening in the groove 21 of the lower cavity 20.

Each elongated rod 2 can also include at least one upper cavity 6. The upper cavity 6 can be configured to hold one or more connection mechanisms 28. In one embodiment, the upper cavity 6 can be configured to detachably and slidably receive the connection mechanisms 28. Each connection mechanism 28 can include a connector 9 and a base 7. a Since connector 9 is threadably attached to base 7, connector 9 can be rotated to allow for connection with a support that runs at any angle in relation to elongated rod 2. The base 7 of each connection mechanism 28 can include holes that may be fastened with a screw from outside the upper cavity 6, thereby securing each connection mechanism 28 into each upper cavity 6 of elongated rod 2. The connector 9 of each connection mechanism 28, for example, a ring or gated hook, can be capable of being fixably suspended from the support 4. Alternatively, the connector 9 can be movably suspended from the support 4, thereby allowing the canopy system to be movably switched from a closed position into an open position by moving the elongated rods 2 along support 4 away from each other, and from an open position into a closed position by moving the elongated rods 2 along support 4 towards each other. In some embodiments, there can be multiple supports 4 for the canopy system, such as multiple cable wires supporting the elongated rods 2. The connectors 9 of multiple connection mechanisms 28 can be suspended, fixed or movably, from the supports 4 on each elongated rod 2.

Various additions to the canopy systemn are possible. For example, each elongated rod 2 may include an endcap 8. In one embodiment, the endcap 8 can be removed prior to inserting the elongated bars 3 connected to each canopy piece 1 into the channels 5 of each elongated rod 2. Moreover, the groove 21 in the at least one lower cavity 20 of each elongated rod 2 can be configured to hold an accessory 22, for example lights 10. The upper cavity 6 of each elongated rod 2 can also be configured to hold second accessories 32 such as a solar charger 33. Furthermore, a distance control thread 11 may be attached to the elongated rods 2 thereby controlling the distance that the elongated rods 2 can be moved along the support 4.

The canopy system provided can be modular, that is, it can be made from readily available components. The length of the canopy system can be increased or decreased by adding or removing, respectively, additional elongated rods 2 along their lengthwise axes. The width of the canopy system from one end of the support 4 to the other can be increased or decreased by adding or removing, respectively, additional elongated rods 2 which can be supported by additional connection mechanisms 28, by adding or removing additional canopy pieces 1 having opposite parallel edges 12, and by adding or removing additional elongated bars 3 attached to the parallel edges 12 of the additional canopy pieces 1.

Figure 2:
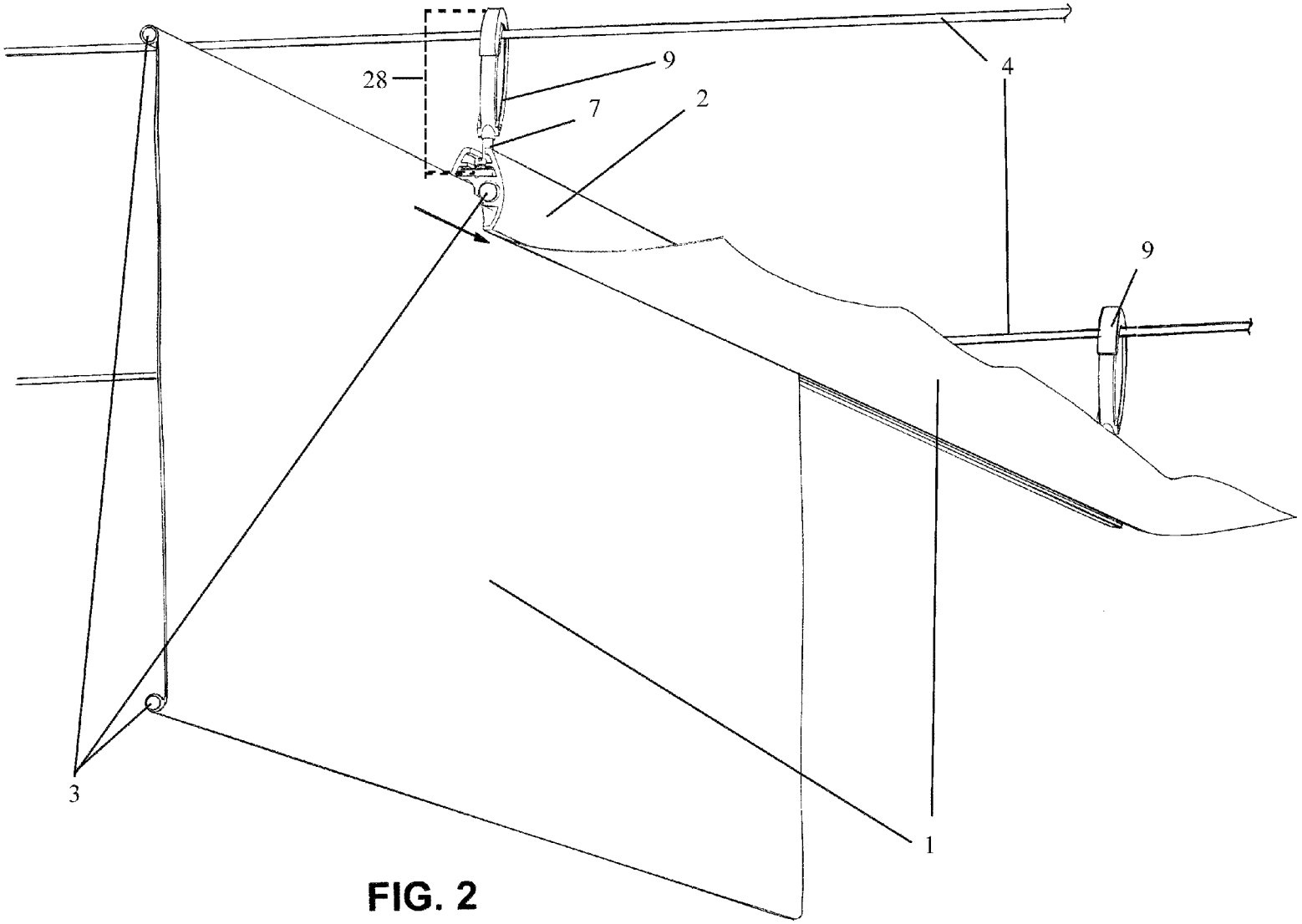
FIG. 2 is a perspective view of an alternate embodiment of the present invention.

FIG. 2 illustrates how each canopy piece 1 connected to elongated bar 3 can be placed inside the at least one lower cavity 20 of each elongated rod 2. The parallel edges 12 of each canopy piece 1 are connected to elongated bars 3. The elongated bars 3, in turn, are held by the at least one lower cavity 20 of each elongated rod 2. In embodiments with channels 5, the elongated bars 3 can be detachably and slidably inserted into the channels 5 of the lower cavity 20 of each elongated rod 2. Each elongated rod 2 is suspended from the support 4 using connector 9 of connection mechanism 28, the base 7 of which can be detachably and slidably inserted and fastened into the at least one upper cavity 6 of elongated rod 2. Each connector 9, for example, a ring or gated hook, can be movably suspended from support 4, thus allowing the canopy system to be switched between a closed position and open position by moving the elongated rods 2 along support 4.

Figure 3:
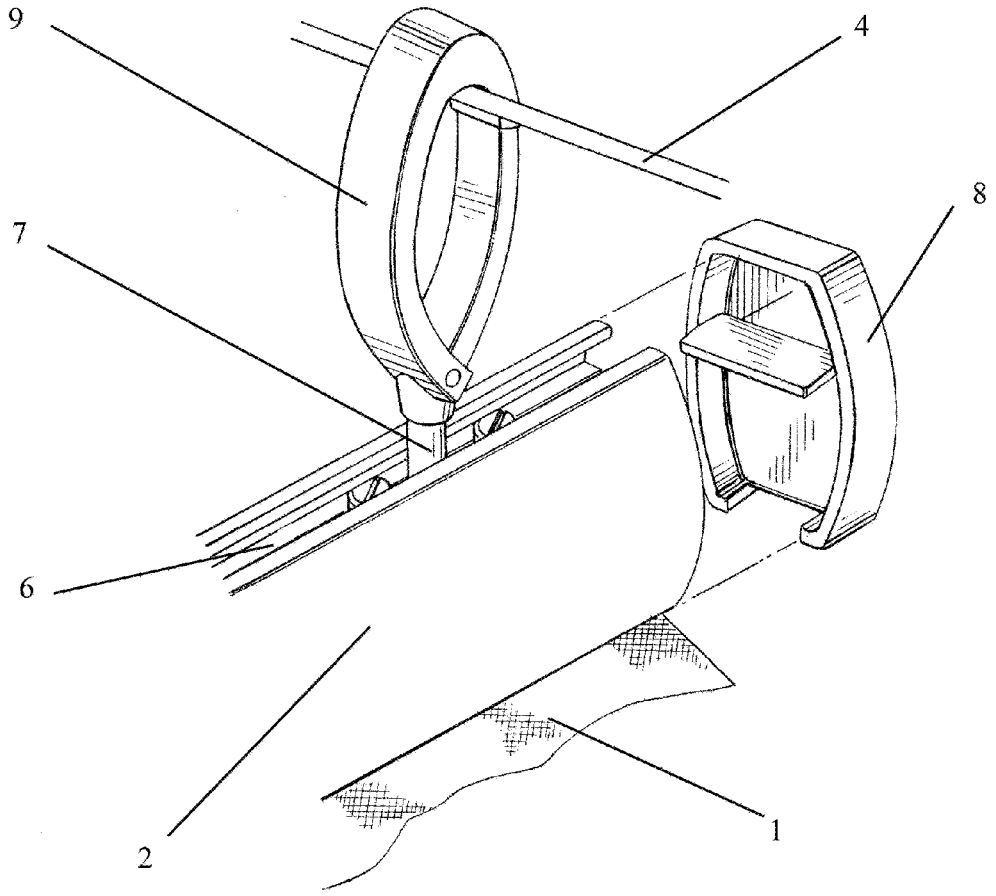
FIG. 3 is a perspective view of the elongated rod and connection mechanism of the canopy system having an endcap.

FIG. 3 illustrates another perspective view of the assembly of elongated rod 2. When endcap 8 is removed, the elongated bars 3 connected to the parallel edges 12 of canopy piece 1 can be detachably and slidably inserted into elongated rod 2 such that the canopy pieces 1 can exit the groove 21 in the at least one lower cavity 20 of elongated rod 2. Moreover when endcap 8 is removed, the base 7 of connection mechanism 28 can be slideably and detachably inserted into the upper cavity 6 of elongated rod 2. The base 7 of connection mechanism 28 can be fastened into the elongated rod 2 from outside the upper cavity 6 using a fastening mechanism such as a screwdriver. The connector 9 of connection mechanism 28 for example, a ring or gated hook, can be fixedly or movably suspended from one or more supports 4, such as a cable wire, where movable suspension allows the canopy system to switch between a closed position and open position.

Figure 4B:
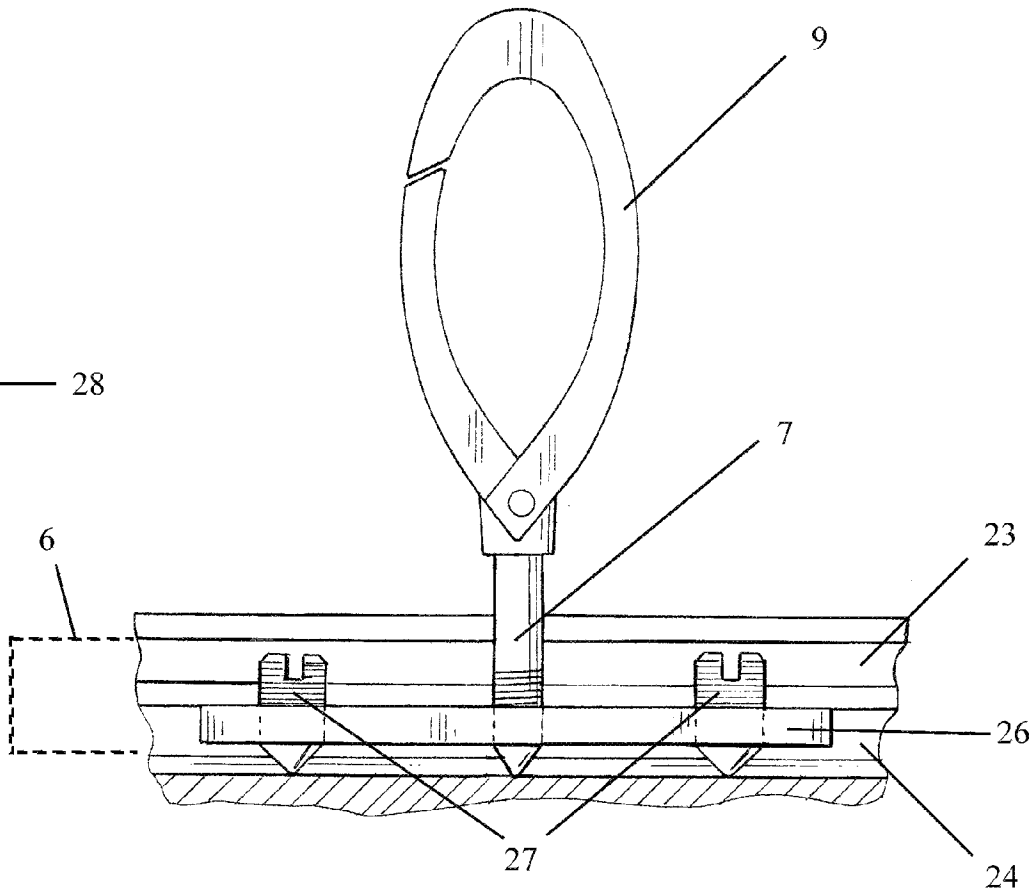
FIG. 4B is a front side view of the connection mechanism in FIG. 4A inserted in the elongated rod.
Figure 4A:
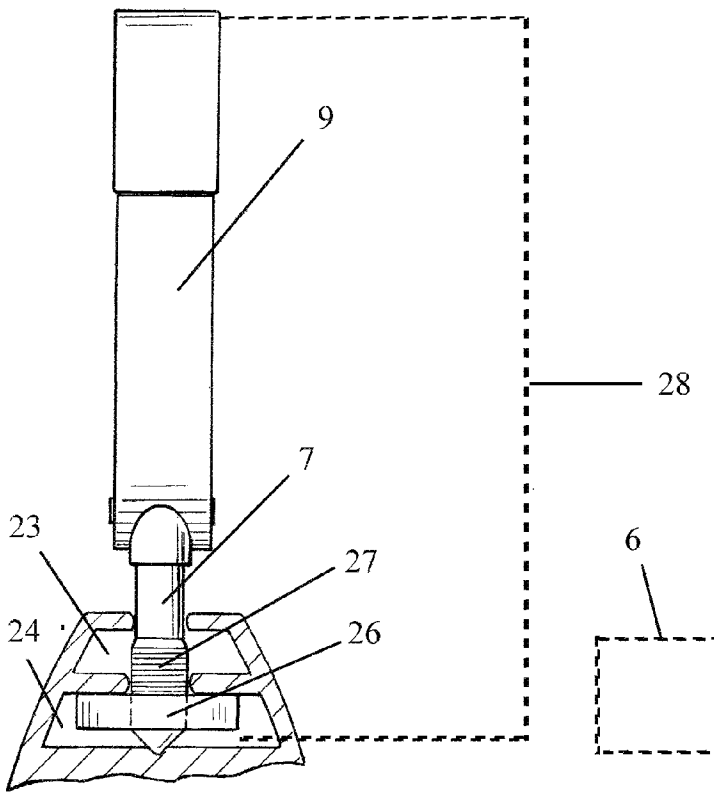
FIG. 4A is a side view of the connection mechanism inserted in the elongated rod.

FIG. 4A and FIG. 4B illustrate the assembly and fastening of the connection mechanism 28 into the elongated rod 2. The upper cavity 6 of the elongated rod 2 can contain an upper track 23 and a lower track 24. The upper track 23 and the lower track 24 allow for sliding various objects such as the base 7 from a first end of the elongated rod 2 to a second end of the elongated rod 2. The base 7 can include a horizontal bar 26 and threaded fasteners 27, such as a screw or bolt. The base 7 can be slidably and detachably inserted into the upper cavity 6 such that the horizontal bar 26 is placed into the lower track 24, the threaded fasteners 27 projecting into the upper track 23. The base 7 can be fastened to the elongated rod 2 using a fastening device such as a screwdriver. The screwdriver can be used to screw in the threaded fasteners 27 from outside the upper cavity 6 until the horizontal bar 26 of connection mechanism 28 is securely fastened inside the lower track 24. The connector 9, for example a ring or gated hook, is attached to the base 7, which can then be suspended from a support 4. The horizontal bar 26 is of a suitable size to slide in the lower track 23. The horizontal bar 26 can be about 0.5 inches to about 1.5 inches wide, and about 2 inches to about 5 inches long. The horizontal bar 26 can have a plurality of threaded holes to allow for the use of the threaded fasteners 27.

In other embodiments, the length of the canopy system can be increased by connecting multiple elongated rods 2 lengthwise. The connection can be achieved by positioning the connection mechanism 28 such that one portion of the horizontal bar 26 with at least one threaded fastener 27 is situated in one elongated rod 2, while the remaining portion of the horizontal bar 26 with at least another threaded fastener 27 is situated in another elongated rod 2. The horizontal bar 26 of the connection mechanism 28 can then be securely fastened inside the lower tracks 24 of both elongated rods 2 such that their threaded fasteners 27 extend into the upper tracks 23 of both elongated rods 2, thereby forming a secure connection between the two elongated rods 2. The length of the canopy system can later be decreased by unfastening the connected elongated rods 2.

Figure 5A:
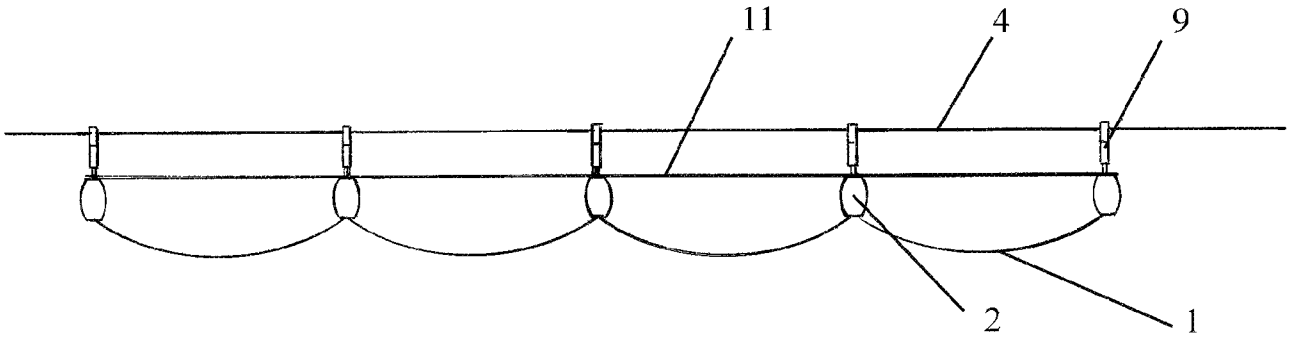
FIG. 5A is a side view of an embodiment of the present invention illustrating the slidably of the canopy system in a more closed position.
Figure 5B:
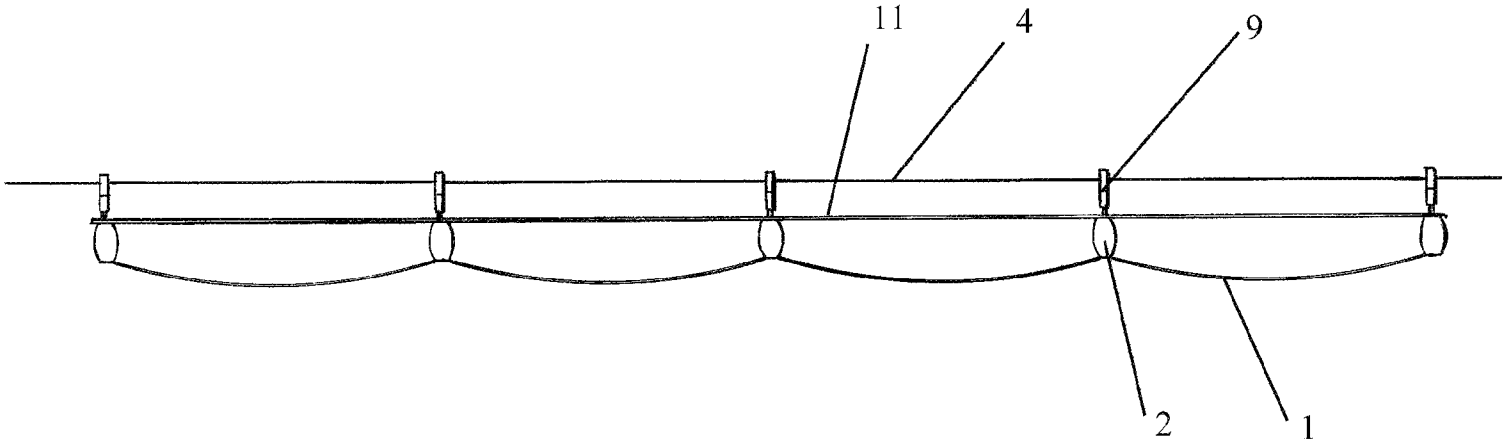
FIG. 5B is a side view of the canopy system of FIG. 5A in a more open position.

FIG. 5A and FIG. 5B illustrate the canopy system as it switches from a position that is more closed in FIG. 5A to a position that is more open in FIG. 5B. In FIG. 5A, the canopy system is in a more closed position, the canopy pieces 1 loosely suspended between the elongated rods 2, the elongated rods 2 being in near proximity to each other. In FIG. 5B, the canopy system is in a more open position, the canopy pieces 1 extended to almost a flat suspension between the elongated rods 2, the elongated rods 2 being in far proximity from each other. In one embodiment, each elongated rod 2 can be moved towards or away from each other along the support 4 to transform the canopy system from a closed position into an open position and vice-versa.

Figure 6:
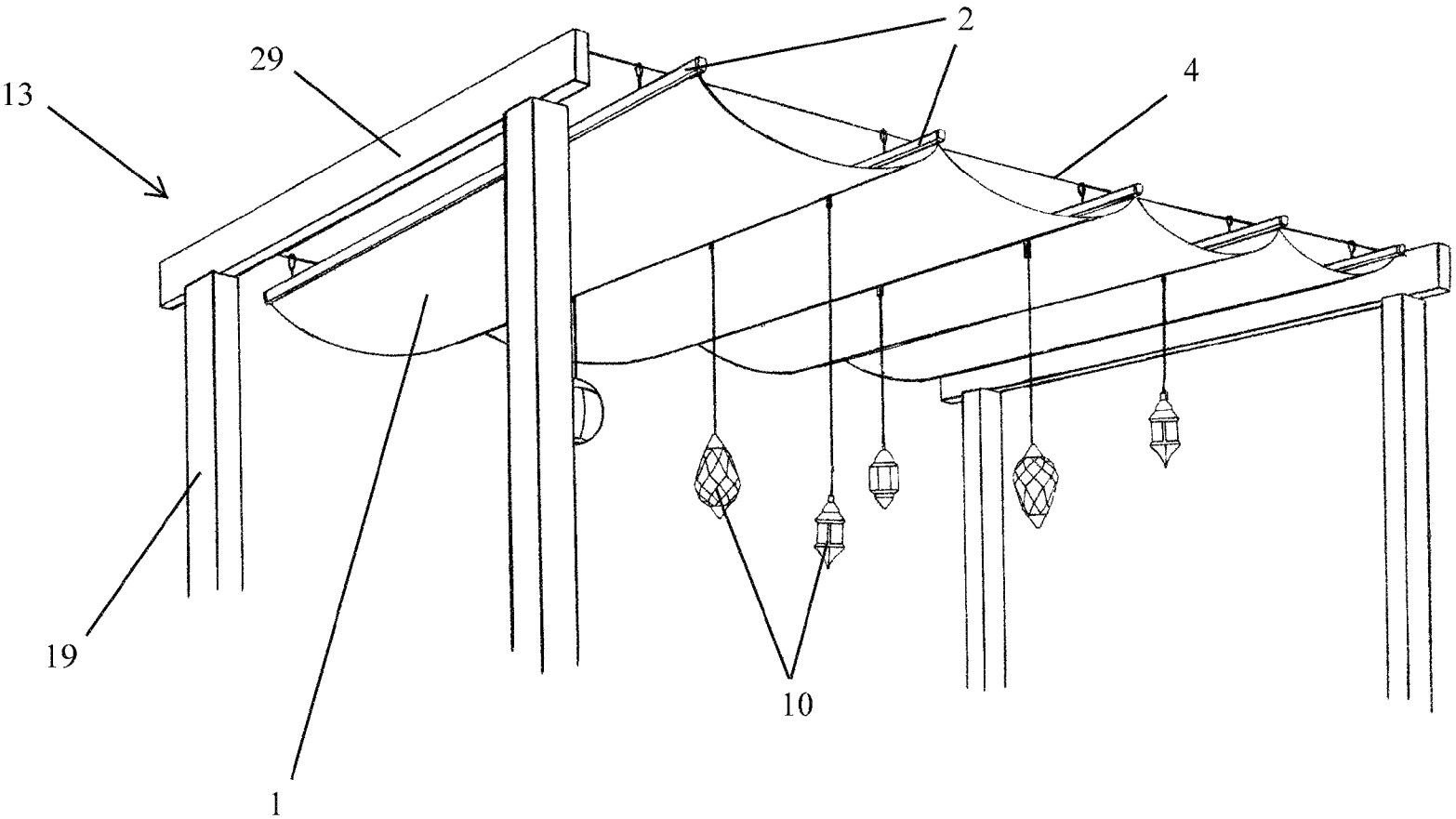
FIG. 6 is a perspective view of an embodiment of the present invention having supporting frames and lights.

FIG. 6 illustrates the use of the canopy system with a supporting frame 13. A supporting frame 13 can be constructed, or readily available, to support the canopy system. It can be created from wood, metal, or other constructive material. The supporting frame 13 can have one or more supporting posts 19 supporting one or more beams 29. The support 4 for the canopy system, such as cable wire, can be attached to the supporting frame 13, for example, by running the wire around four rings 15 or hooks placed at each corner of the beams 29 and then attaching and joining together each end of the wire using a cable wire connector 14.

Accessories 22 can be suspended from each elongated rod 2, as illustrated in FIG. 1A, FIG. 1B, and FIG. 6. Examples of accessories include lights 10, insect repellant, Speakers, projectors, mist producers (humidifiers), fans, decorations, and other functional items. The accessories 22, such as lights 10, can be attached to the elongated rods 2 such that they are suspended beneath the canopy pieces 1. Accessories 22 can be attached by attaching the accessory 22 to a holder 25. The holder 25 can be detachably and slidably placed inside the lower cavity 20 of the elongated rod 2. It is possible to manufacture a holder 25 that has a standard connection to different accessories 22 so that a user may use the same holder 25 with different accessories 22.

Figure 7:
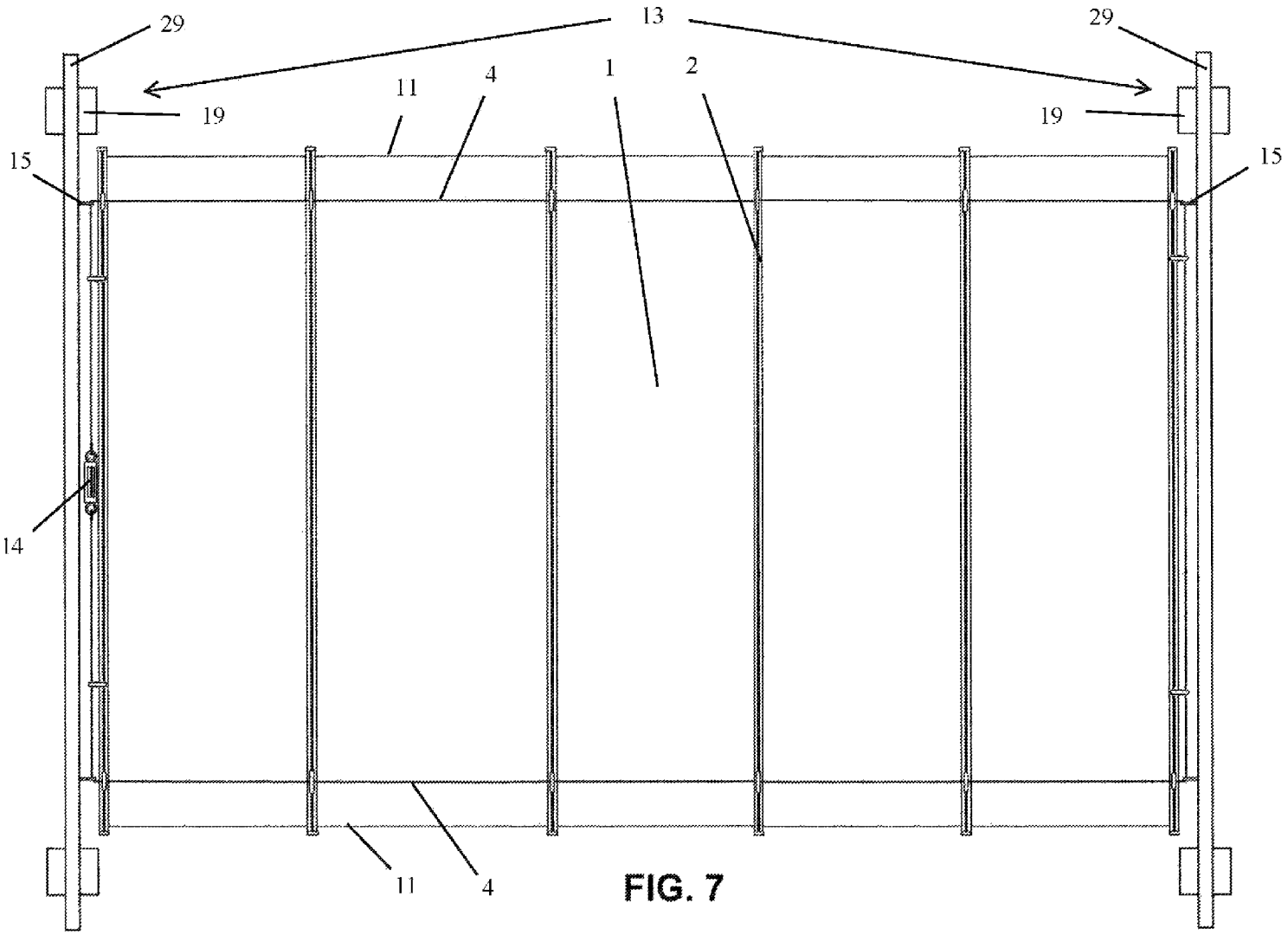
FIG. 7 is a top view of an embodiment of the present invention having supporting frames.

FIG. 7 illustrates a top view of the canopy system that is supported by the supporting frame 13. The canopy system may be supported by attaching support 4, for example cable wire, to supporting frame 13. Multiple supports 4 can be connected on opposite sides of supporting frame 13 using a cable wire connector 14. The support 4 can run through four rings 15 each connected to a corner of the beams 29 of supporting frame 13, the beams 29 placed in parallel fashion to each other. The rings 15 can be attached to the supporting frame 13, for example by fastening or pressing each ring 15 into the supporting frame 13. A hook can also be used instead of a ring 15. Each end of the cable can be attached together with a cable wire connector 14.

Figure 8:
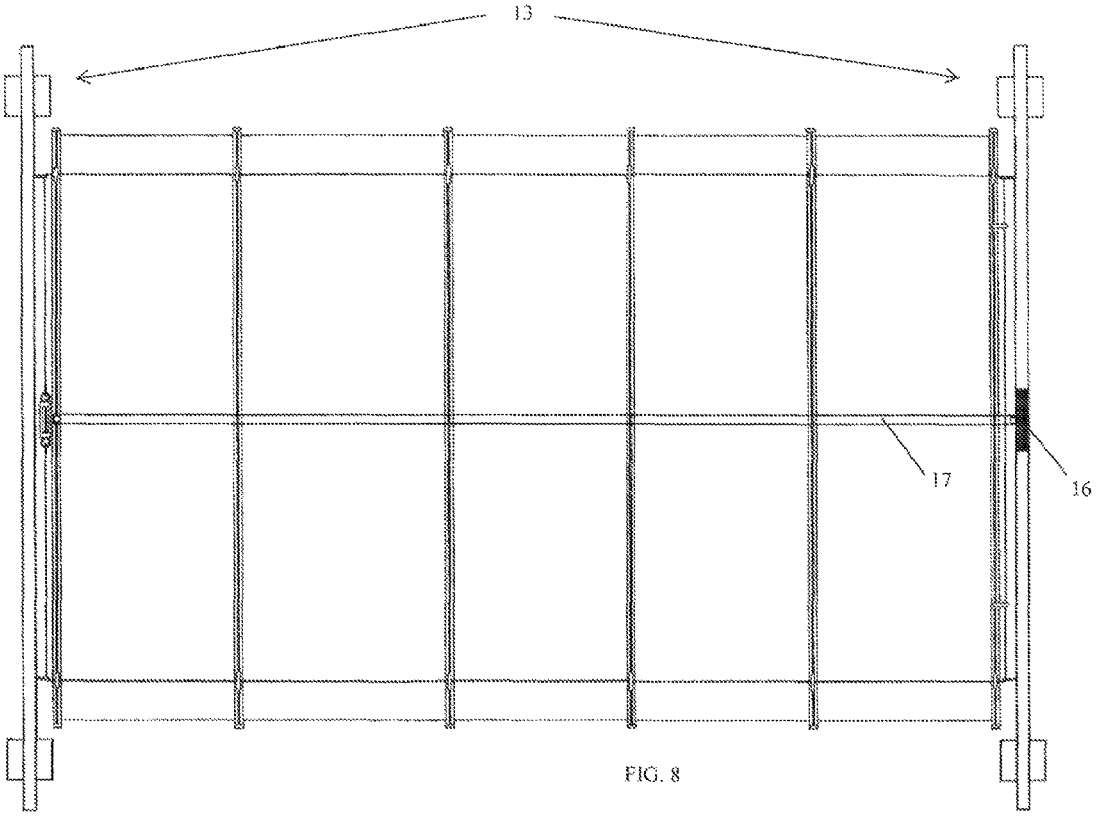
FIG. 8 is a top view of an alternate embodiment of the present invention having supporting frames with a motor and pulley.

FIG. 8 describes another embodiment where the supporting frame 13 can include a motor 16 and a pulley 17 system. The motor 16 and the pulley 17 can be attached to opposite beams 29 of supporting frame 13. When the motor 16 is activated, the motor 16 interacts with pulley 17 such that the elongated rods 2 are moved towards or away from the motor 16. In this way, the motor 16 and pulley 17 can be used to switch the canopy system from a closed position to an open position and vice-versa.

Figure 9A:
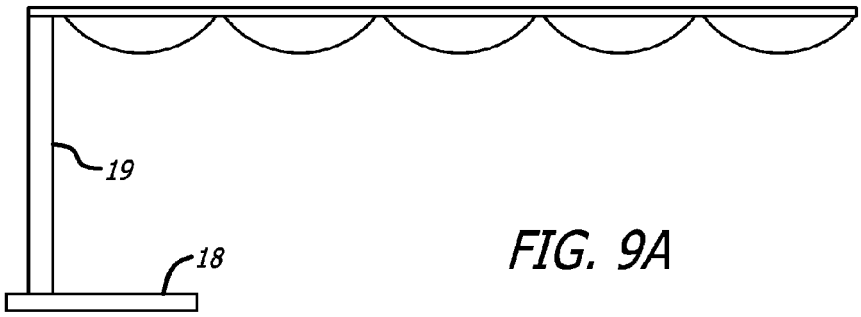
FIG. 9A illustrates a side view of a free standing unit having a side support.
Figure 9B:
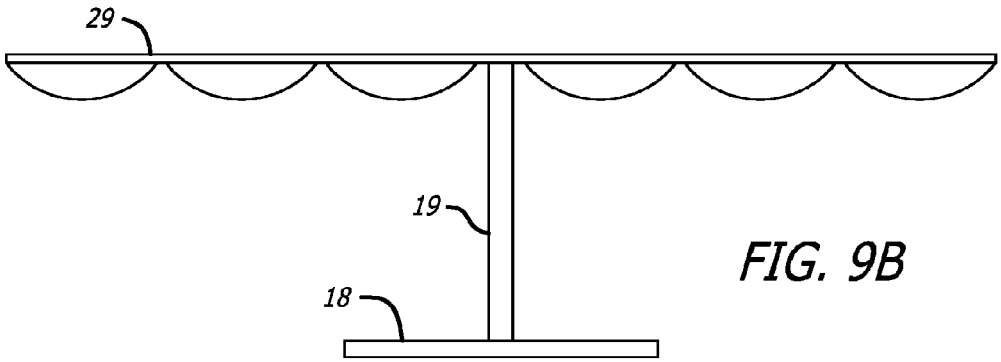
FIG. 9B illustrates a side view of a free standing unit having a center support.

FIGS. 9A and 9B illustrate various free standing canopy systems that can be readily purchased. These canopy systems can be purchased as-is and there is no additional need to provide an external, stand-alone supporting frame 13 for the canopy system since these free standing units come with their own supporting frame 13. Each free standing unit can come with a supporting base 18 that rests on the ground, at least one supporting post 19 connected at one end to the supporting base 18, and at least one beam 29 attached at the opposite end of supporting post 19 which is supported by the support post 19. The canopy system would operate substantially as shown in FIG. 6.

The material for the canopy pieces 1 can be any suitable material that allows for closing and opening the canopy system. Suitable materials include solid, mesh, and canvas fabric, including fabric that is made from natural or synthetic material, such as cotton, silk, or polyester. Solid sheets of synthetic materials such as plastic or metal can be used as long as the sheet is flexible and allows for the canopy system to open and close. The material can be transparent, translucent, or opaque. The material can be waterproof.

Figure 10:
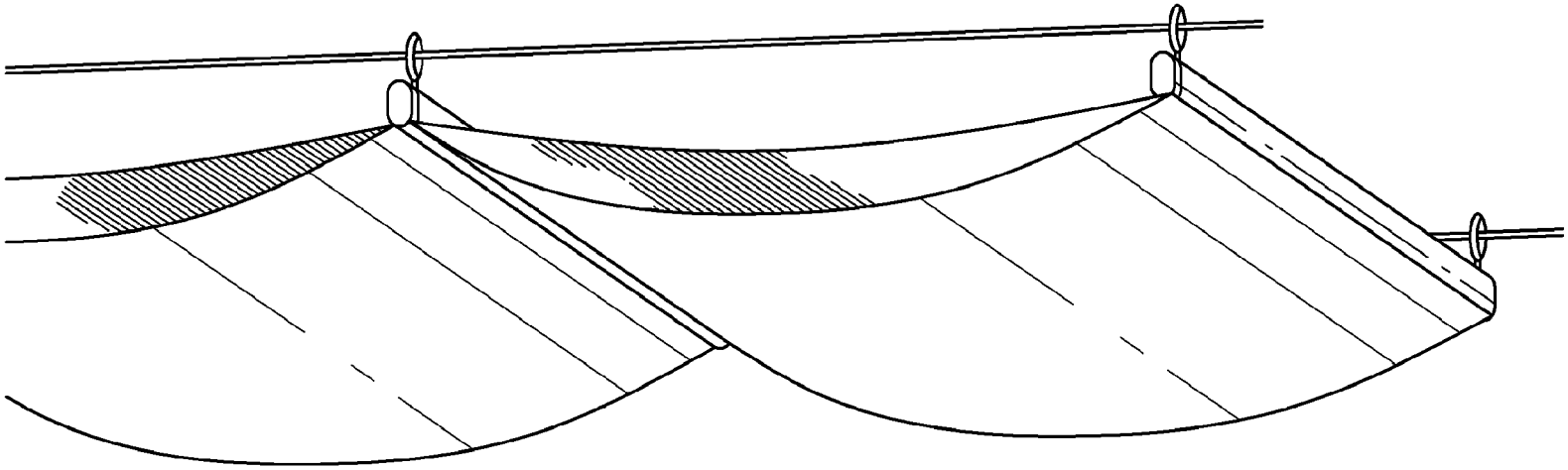
FIG. 10 illustrates a canopy system with a top fabric and a bottom fabric.

FIG. 10 illustrates an embodiment where two pieces are fabric material, a top material 30 and a bottom material 31, are used as a canopy piece 1 in vertical relationship with each other. The top material 30 can be a protective waterproof material, while the bottom material 31 can be a less durable but ornamental piece of material. The top material 30 can also act as a distance control in lieu of a distance control thread 11. Both the parallel edges of the top material 30 and the parallel edges of the bottom material 31 can be connected to the same elongated bars 3, i.e., two parallel edges are connected to each elongated bar 3, which can dictate a design for an elongated rod 2 with two channels 5. In another embodiment, each parallel edge of the top material 30 is connected to a separate elongated bar 3, while each parallel edge of the bottom material 31 is connected to a separate elongated bar 3, i.e., one parallel edge is connected to each elongated bar 3, which can dictate a design for the elongated rod 2 with four channels 5.

Figure 11A:
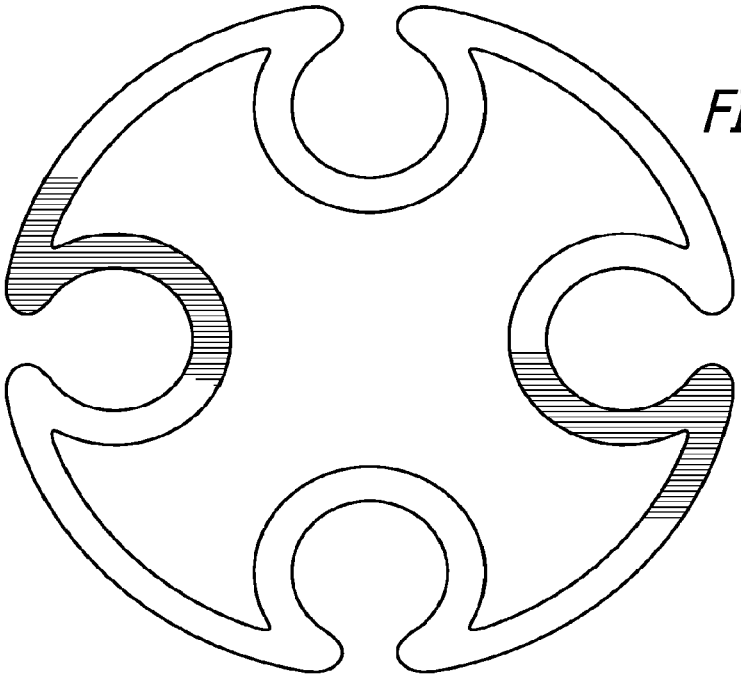
FIG. 11A illustrates a side profile of an elongated rod.
Figure 11B:
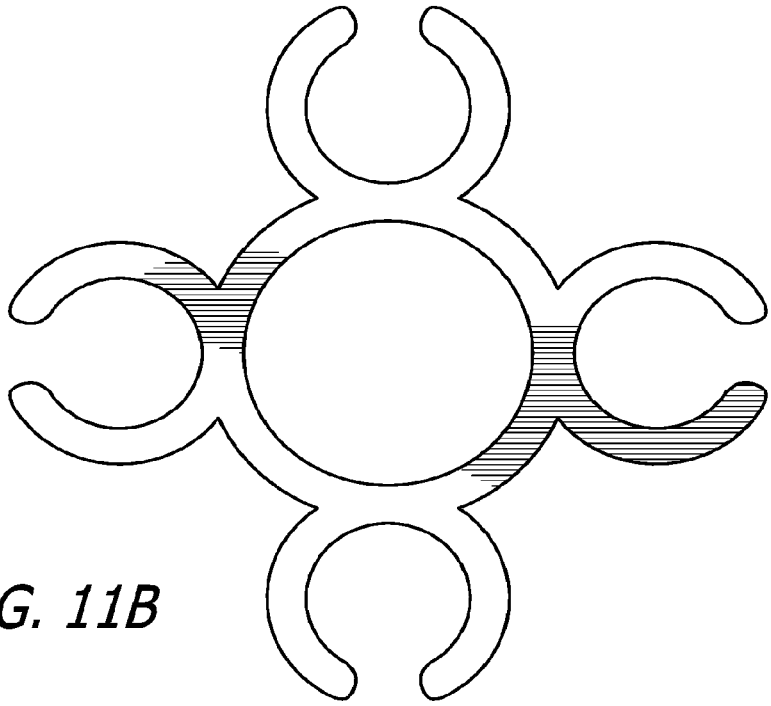
FIG. 11B illustrates a side profile of an elongated rod.

FIGS. 11A and 11B illustrated additional side profiles of the elongated rod 2. Elongated bar 3 can be inserted in the circular or semi-circular rings on the outside of the elongated rod 2. The other rings of the elongated rod 2 can be used for suspending the elongated rod 2 and/or for attaching canopy pieces.

Figure 12:
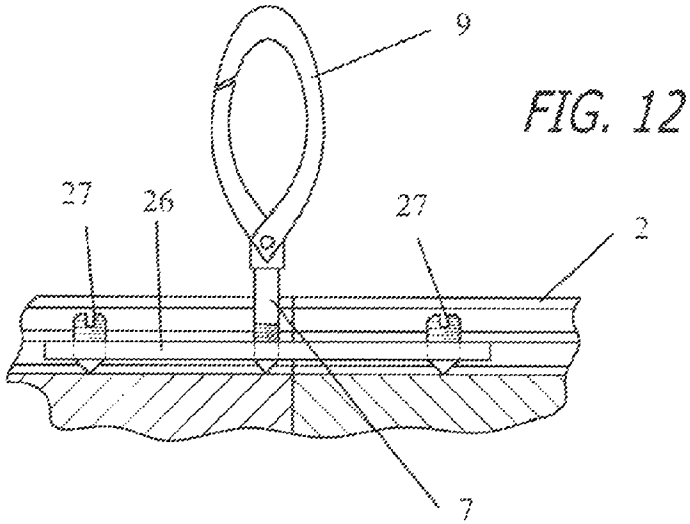
FIG. 12 illustrates attachment of two elongated rods end to end.
Figure 13:
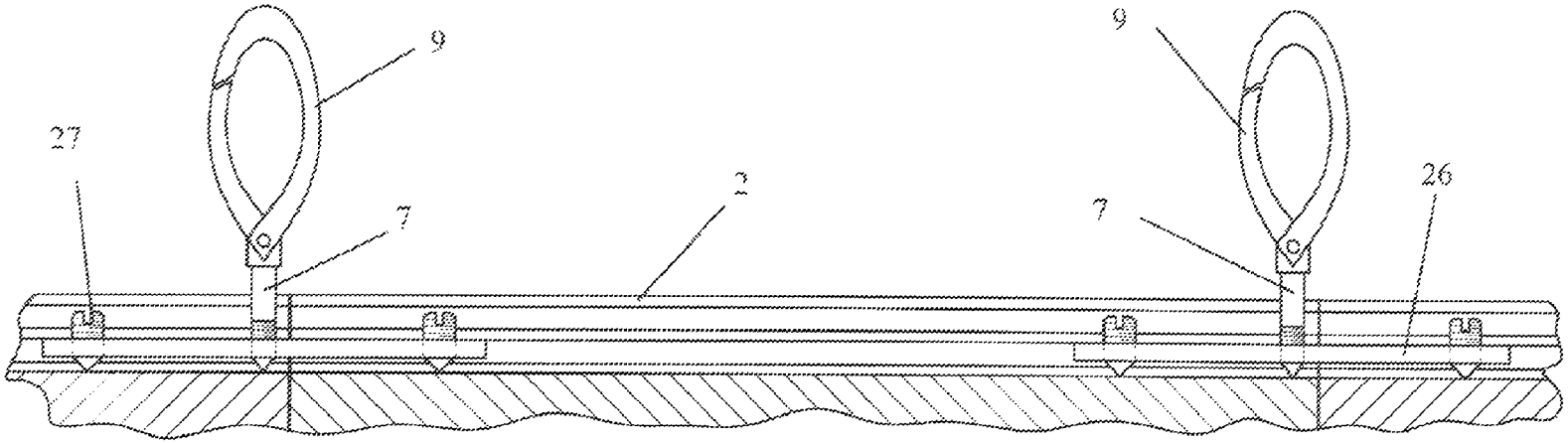
FIG. 13 illustrates attachment of three elongated rods end to end.

FIGS. 12 and 13 illustrate attaching elongated rod 2 end to end to each other. The horizontal bar 26 is moved to overlap with two of the elongated rods 2, and the threaded fasteners 27 are used to stabilize the attachment.

Figure 14:
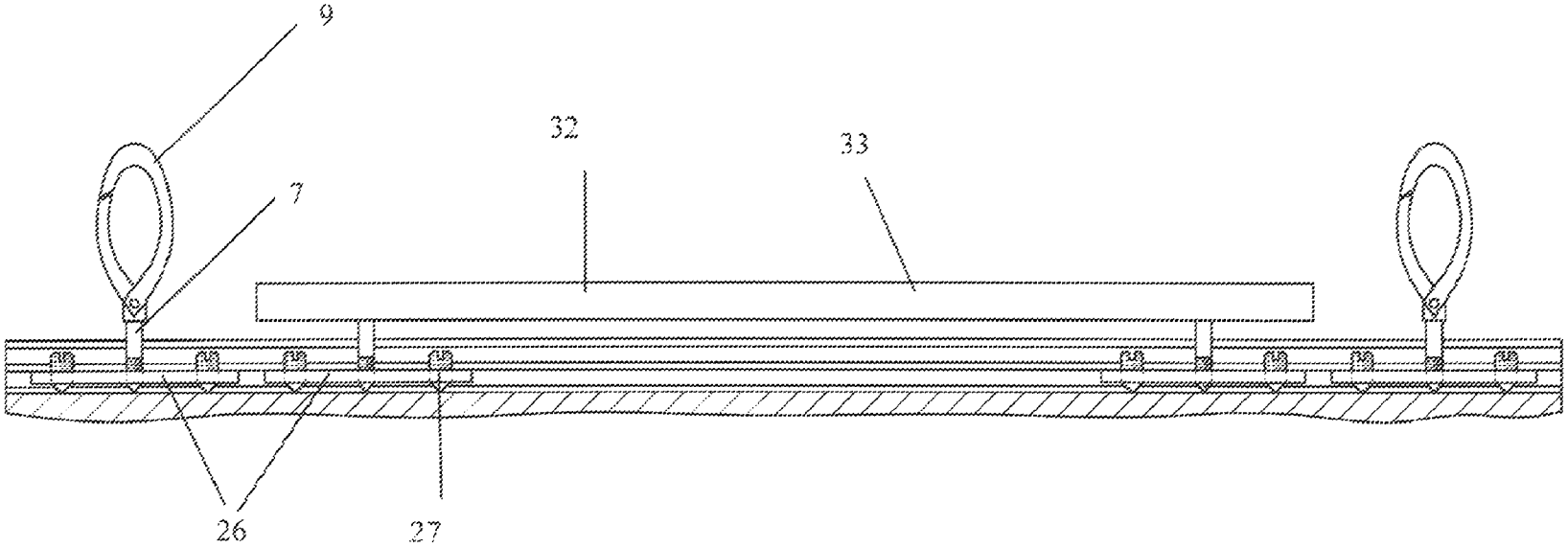
FIG. 14 illustrates attachment of a solar panel to an elongated rod.

FIG. 14 illustrates attachment of a solar panel 33 as a second accessory to the elongated rod 2. The solar panel can be attached by using horizontal bar 26 and base 7.

The width of the elongated rod 2 can range between 15 millimeters and 25 millimeters. The height of the elongated rod 2 can range between 24 millimeters and 34 millimeters. The width of the groove 21 of the lower cavity 20 can range between 12 millimeters and 19 millimeters. The height of the groove 21 of the lower cavity 20 can range between 5 millimeters and 9 millimeters. The diameter of the tubular channels 5 can range between 7 millimeters and 9 millimeters. The width of the opening from the groove 21 into the tubular channels 5 can range between 4 millimeters and 7 millimeters. The width of the opening into the groove 21 from outside the elongated rod 2 can range between 4 millimeters and 9 millimeters. The width of the upper track 22 of the upper cavity 6 can range between 7 millimeters and 12 millimeters. The width of the lower track 23 of the upper cavity 6 can range between 11 millimeters and 17 millimeters. The height of the upper track 22 can range between 2 millimeters and 5 millimeters. The height of the lower track 23 can range between 2 millimeters and 5 millimeters. The width of the opening into the upper cavity 6 from outside the elongated rod 2 can range between 3 millimeters and 8 millimeters.

A user can obtain and construct a supporting frame 13 having one or more support posts 19 supporting one or mor beams 29. The user can separately obtain one or more supports 4 for the canopy system, such as cable wire, and attach it to the supporting frame 13, for example, by running the wire around four rings 15 or hooks placed at each corner of the beams 29 and then attaching and joining together each end of the wire using a cable wire connector 14. Alternatively, the user may obtain a free standing unit having a supporting base 18 that rests on the ground, at least one supporting post 19 connected at one end to the supporting base 18, and at least one beam 29 attached at the opposite end of supporting post 19 which is supported by the supporting post 19, with support 4 and the canopy system already attached. The user can also obtain a supporting frame 13 having a motor 16 and a pulley 17.

The user can obtain a canopy piece 1 and two elongated bars 3 and can roll and attach the parallel edges 12 of the canopy piece 1 to the elongated bars 3. The user can then insert each elongated bar 3 into the channels 5 of two, separate elongated rods 2 such that the canopy piece 1 is held in place between the two elongated rods 2. The user can obtain a connection mechanism 28, having a connector 9 attached to a base 7, the base 7 having a horizontal bar 26 and one or more threaded fasteners 27, which the user can slidably insert into the elongated rod 2 by placing the horizontal bar 26 into the lower track 24 of the upper groove 6 with the threaded fasteners 27 projecting into the upper track 23 of the upper cavity 6. The base 7 may be fastened to the elongated rod 2 using a fastening device such as a screwdriver, which may be used to screw in the threaded fasteners 27 from outside the upper cavity 6 until the horizontal bar 26 of connection mechanism 28 is securely fastened inside the lower track 24. The user can then fixably or movably suspend the connector 9, for example a ring or gated hook, of the securely fastened connection mechanism 28 from the support 4 attached to the supporting frame 13. The user can also attach accessories 22, such as lights 10, to a holder 25, which the user can slidably insert inside the groove 21 of the lower cavity 20 of each elongated rod 2. The user can also insert second accessories 32, such as a solar charger, into the upper cavity 6 of each elongated rod 2. The user can repeat this process by attaching additional canopy pieces 1 to additional elongated rods 2 and movably suspending each elongated rod 2 from the one or more supports 4, thereby allowing the canopy system to be movably switched from a closed position into an open position by moving the elongated rods 2 along support 4 away from each other, and from an open position into a closed position by moving the elongated rods 2 along support 4 towards each other. The user may also attach a distance control thread 11 to the elongated rods 2 thereby controlling the distance that the elongated rods 2 can be moved along the support 4.

Figure 15:
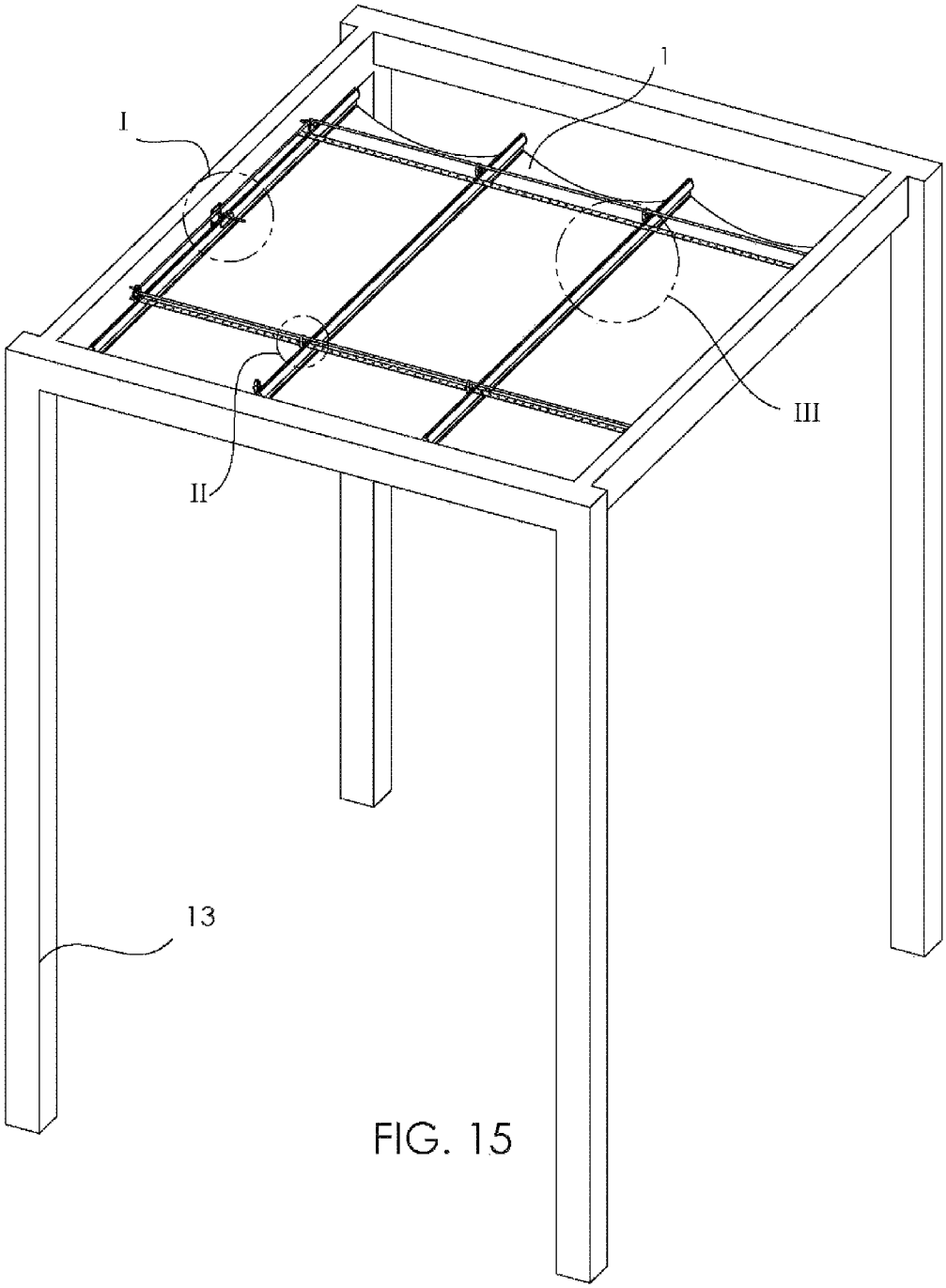
FIG. 15 illustrates an isometric view of canopy with a cable on top.
Figure 15C:
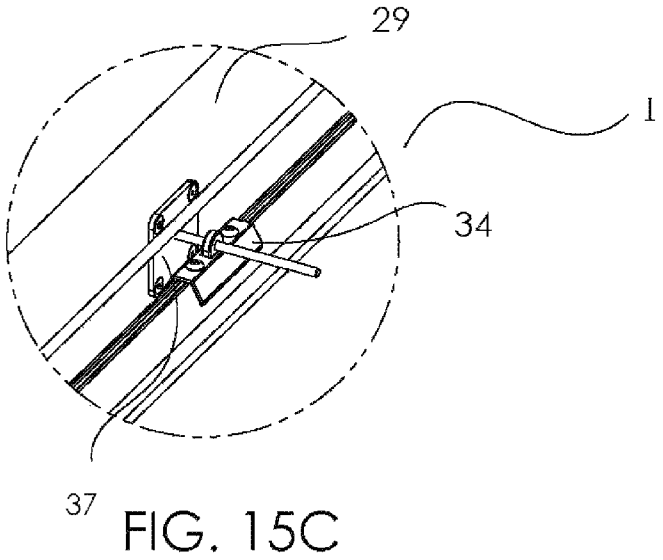
FIG. 15C (corresponding to Roman numeral I in FIG. 15) a close-up of a magnet assembly attached to rod.
Figure 15B:
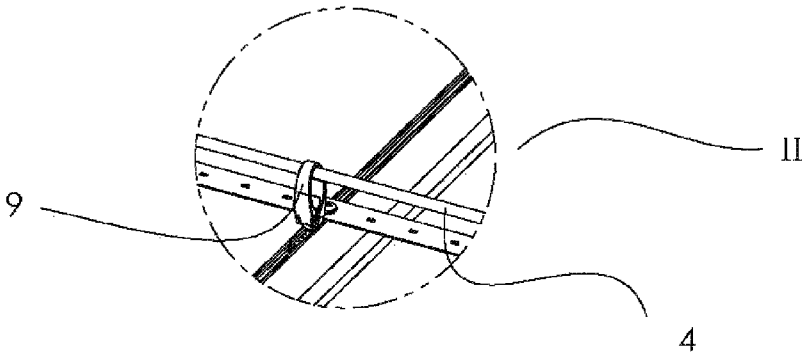
FIG. 15B (corresponding to Roman numeral II in FIG. 15) illustrates the attachment of both connector and distance control thread to the top of the elongated rod.
Figure 15A:
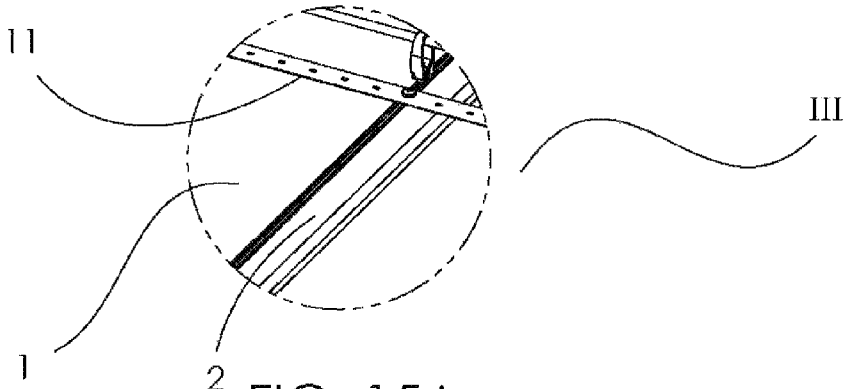
FIG. 15A (corresponding to Roman numeral III in FIG. 15) illustrates attachment of distance control thread to the top of elongated rod with a fastener in a perpendicular direction.

FIG. 15 illustrates an isometric view of canopy with a cable on top. The canopy pieces 1 are attached to elongated rods 2 through connectors 9 which are suspended from support (cable) 4. Distance control thread 11 is attached to the top of elongated rod 2 and limits the distance from one elongated rod 2 to another elongated rod 2. Support 4 runs through rings 15 attached to supporting frame 13. FIG. 15A illustrates attachment of distance control thread 11 to the top of elongated rod 2 with a fastener in a perpendicular direction. FIG. 15B illustrates the attachment of both connector 9 and distance control thread 11 to the top of the elongated rod 2. Support (cable) 4 passes through inside of connector 9 in a perpendicular direction to elongated rod 2. FIG. 15C is a close-up of a magnet assembly attached to rod 2. The magnet assembly makes a magnetic connection with magnetic plate 37 on supporting frame 13 to stabilize the canopy in an open position. Magnetic plate 37 can be magnetized or be a metal that has not been magnetized. The magnet assembly is attached to the top of elongated rod 2.

Figure 16B:
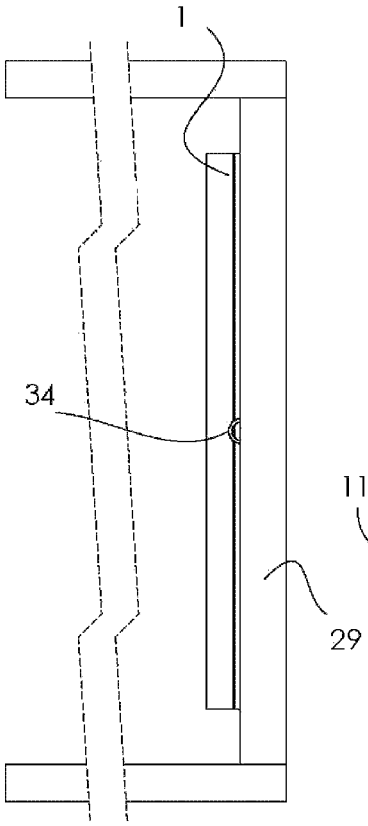
FIG. 16B illustrates a handle, which can be accessed manually to change the position of the canopy.
Figure 16:
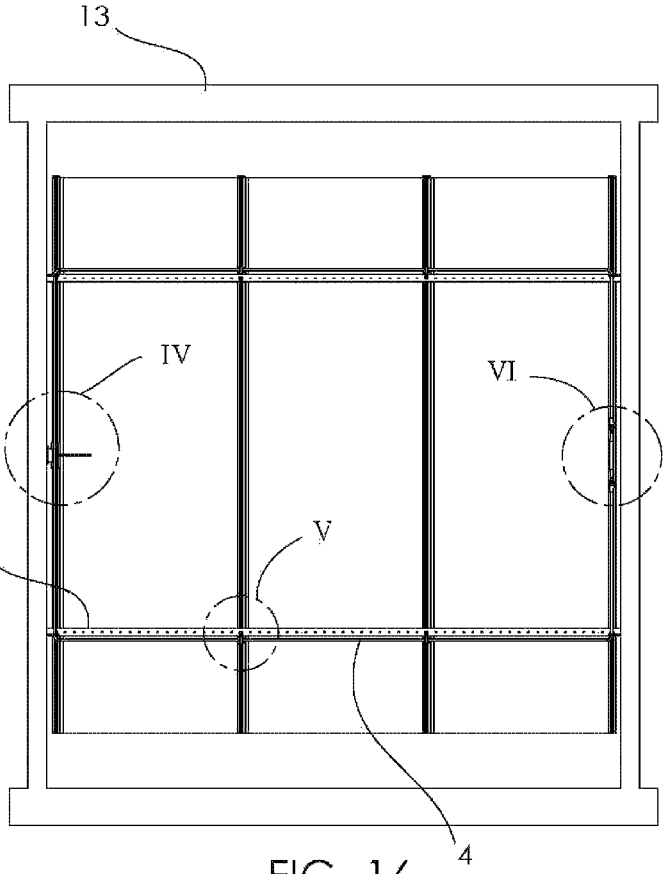
FIG. 16 illustrates a top view of the canopy with a cable on top that is illustrated in FIG. 15.
Figure 16A:
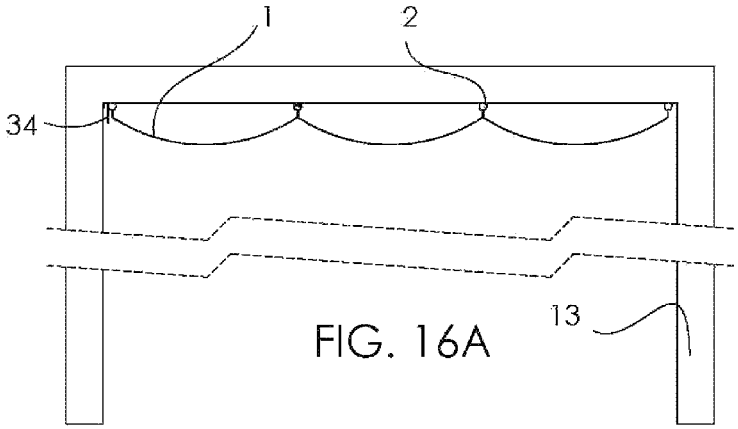
FIG. 16A illustrates connection of canopy pieces to elongated rods.
Figure 16D:
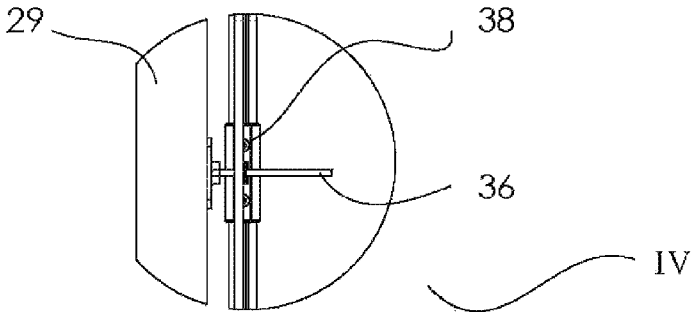
FIG. 16D (corresponding to Roman numeral IV in FIG. 16) illustrates the canopy in an open position with the magnetic assembly that is attached to elongated rod making a magnetic connection with a magnetic plate.
Figure 16E:
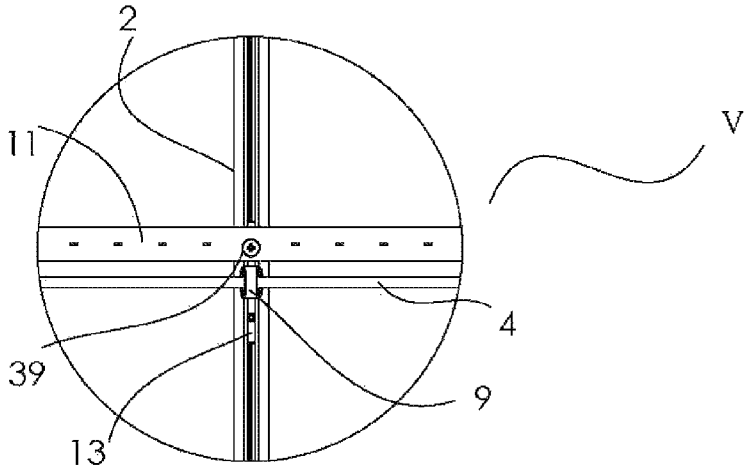
FIG. 16E (corresponding to Roman numeral V in FIG. 16) illustrates the attachment of both connector and distance control thread to the top of the elongated rod.
Figure 16C:
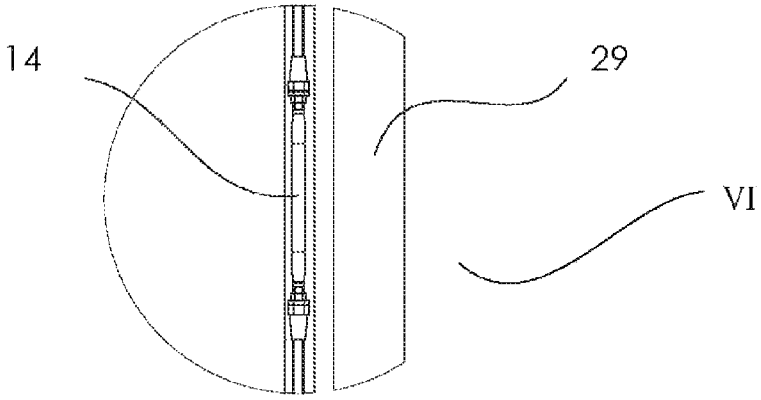
FIG. 16C (corresponding to Roman numeral VI in FIG. 16) illustrates connection of the ends of's cable wire to each other through a cable wire connector.

FIG. 16 illustrates a top view of the canopy with a cable on top that is illustrated in FIG. 15. FIG. 16A is a side view illustrating connection of canopy pieces 1 to elongated rods 2, and canopy pieces 1 drooping down from the elongated rods 2 which are attached to support frame 12. Also illustrated is handle 34 for changing the position of the canopy from an open (deployed) position to a closed (stowed) position, and vice-versa. FIG. 16B illustrates the same handle 34, which can be accessed manually to change the position of the canopy, FIG. 16C illustrates the connection of the ends of cable wire 4 to each other through Cable wire connector 14. FIG. 16D illustrates the canopy in an open position with the magnetic assembly that is attached to elongated rod 2 making a magnetic connection with a magnetic plate 37 on beam 29 to stabilize the canopy system in the open position. The magnetic plate 37 can be an actual magnet or a metal that can form a magnetic connection. FIG. 16E illustrates the attachment of both connector 9 and distance control thread 11 to the top of the elongated rod 2. Support (cable) 4 passes through inside of connector 9 in a perpendicular direction to elongated rod 2. In this illustration, because of the proximity of the distance control thread 11 to connector 9, horizontal bar 26 of connector 9 can be positioned under the distance control thread 11, and the fastener 38 that goes through the opening of distance control thread 11 also goes into the opening of the horizontal bar 26. In this arrangement, fastener 38 also performs the role of fastener 27 (Se FIG. 21*b*).

Figure 17B:
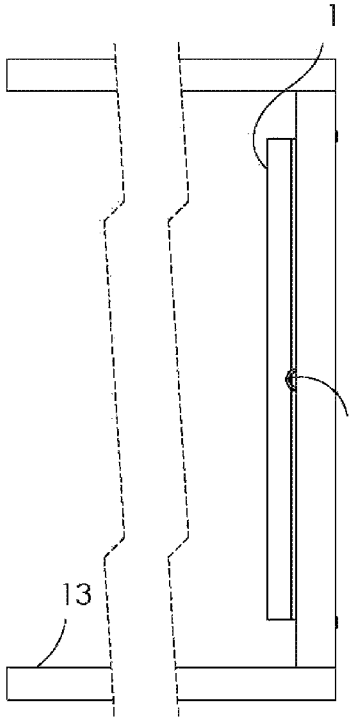
FIG. 17B illustrates a handle, which can be accessed manually to change the position of the canopy.
Figure 17:
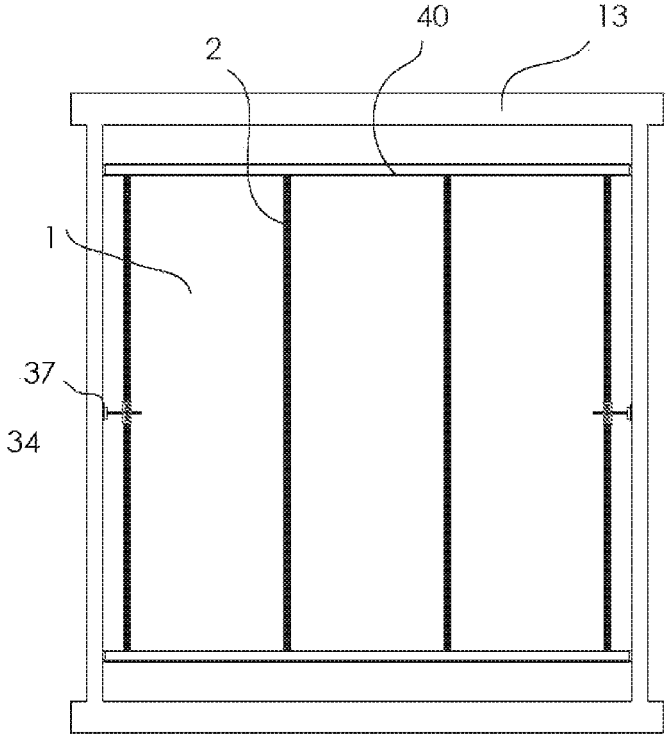
FIG. 17 illustrates top view of the canopy with roller tracks.
Figure 17A:
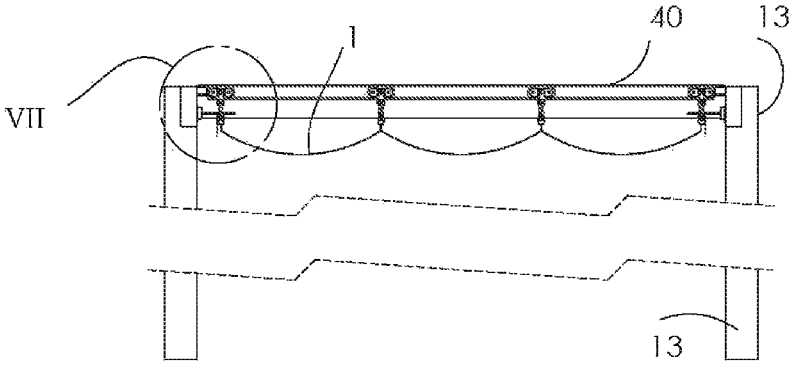
FIG. 17A illustrates a side view of the canopy system illustrating roller track.
Figure 17C:
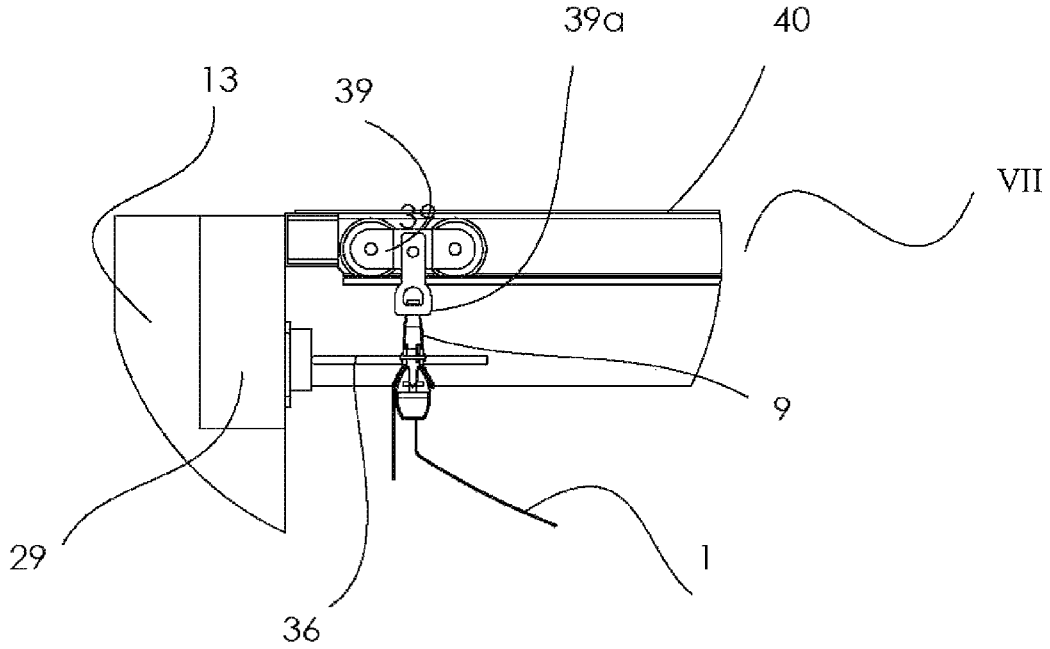
FIG. 17C (corresponding to Roman numeral VII in FIG. 17) illustrates a closer view of the roller track.

FIG. 17 illustrates top view of the canopy with roller track 40, which are attached to support frame 12 and run in perpendicular direction to elongated rods 2. FIG. 17A is a side view of the canopy system illustrating roller track 40. FIG. 17B illustrates the same handle 34, which can be accessed manually to change the position of the canopy. FIG. 17C is a closer view of the roller track 40, which run in perpendicular direction to elongated rods 2. Rollers 39 can rollably move in roller track 40. Rollers carriage 39 can have a roller mounting loop 39*a* for attachment connector 9 of elongated rod 2.

Figure 18:
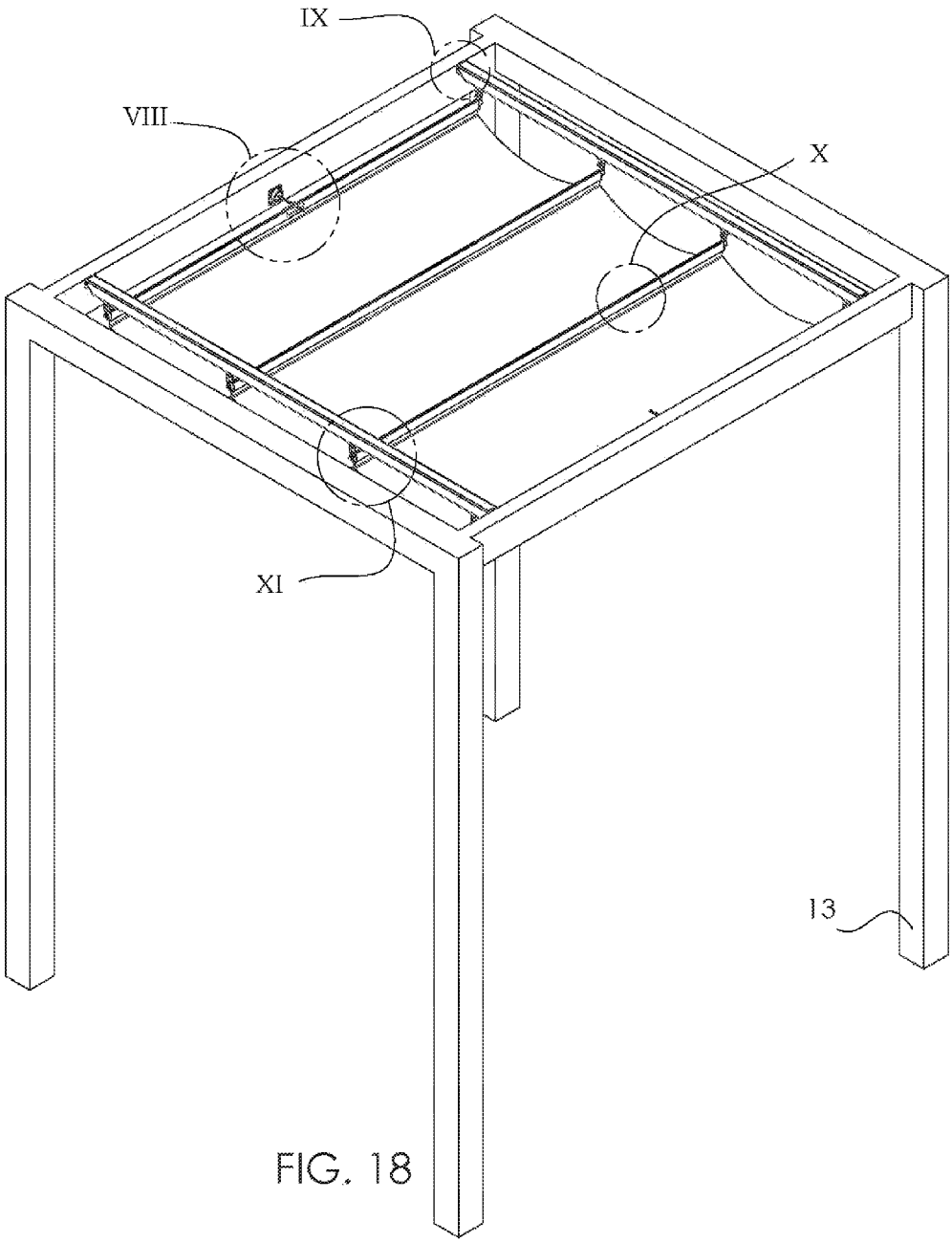
FIG. 18 is an isometric view of the canopy system with roller tracks and a magnet assembly.
Figure 18C:
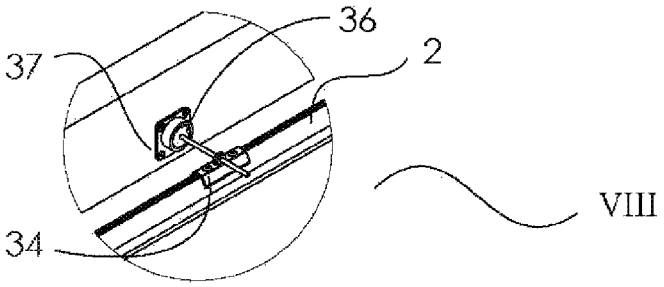
FIG. 18C (corresponding to Roman numeral VIII in FIG. 18) illustrates magnet assembly with adjustable ceramic magnet.
Figure 18D:
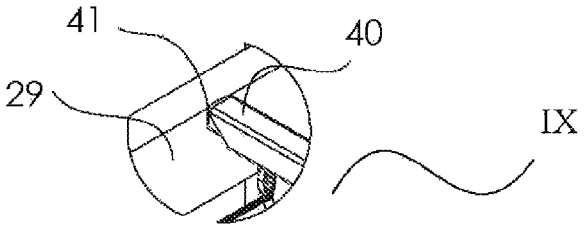
FIG. 18D (corresponding to Roman numeral IX in FIG. 18) illustrates roller track attached to a beam.
Figure 18B:
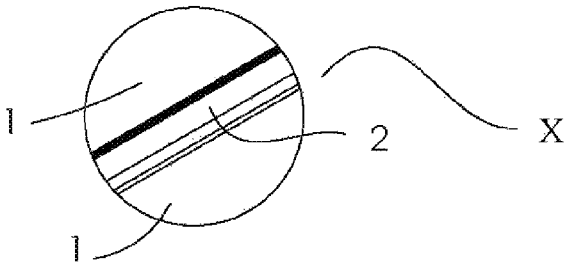
FIG. 18B (corresponding to Roman numeral X in FIG. 18) illustrates canopy pieces on each side of elongated rod.
Figure 18A:
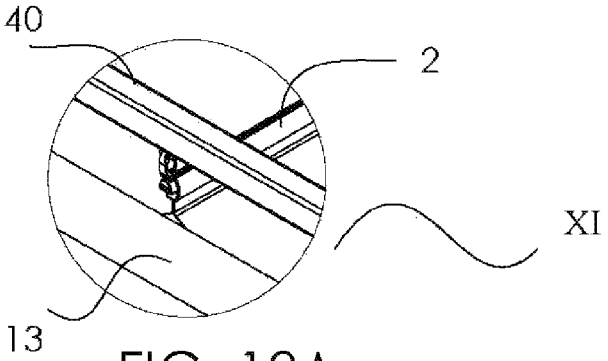
FIG. 18A (corresponding to Roman numeral XI in, FIG. 18) illustrates roller track running parallel to a support beam and perpendicular to elongated rod.

FIG. 18 is an isometric view of the canopy system with roller tracks 40 and a magnet assembly. Roller tracks 40 are attached to supporting frame 13 by roller track mounting bracket 41. Elongated rods 2 are placed in perpendicular direction to the roller track 40 and slide along roller track 40. FIG. 18A illustrates roller track 40 running parallel to support beam 12 and perpendicular to elongated rod 2. Elongated rod 2 is suspended from and supported by track 40. In this embodiment, the elongated rod 2 is not directly attached to supporting frame 13. FIG. 18B illustrates canopy pieces 1 on each side of elongated rod 2. FIG. 18C illustrates magnet assembly with adjustable ceramic magnet 36. The magnet assembly makes a magnetic connection with a magnetic plate 37 that is placed on supporting frame 13. Also illustrated is an isometric view of the handle 34 attached to rod 2. FIG. 18D illustrates roller track 40 attached to beam 29 of supporting frame 13 with the use of track mounting 41.

Figure 19D:
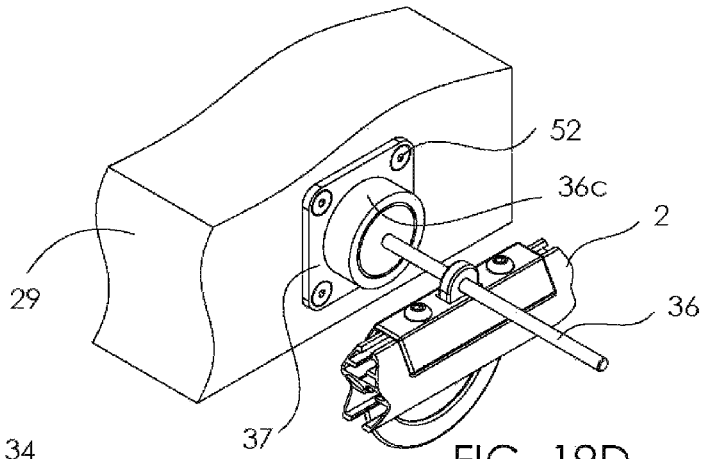
FIG. 19D illustrates a handle attached to elongated rod with fasteners.
Figure 19B:
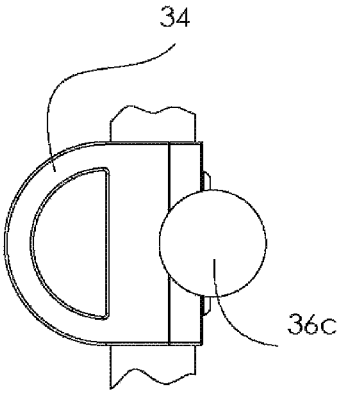
FIG. 19B illustrates a handle, as well as magnet protective cap.
Figure 19A:
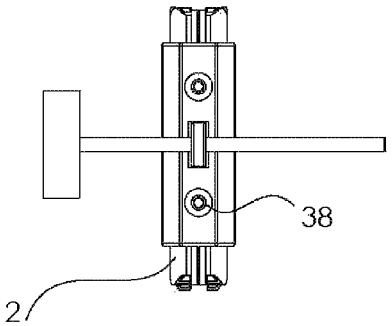
FIG. 19A illustrates attachment of a handle to the top of elongated rod with fasteners 38.
Figure 19C:
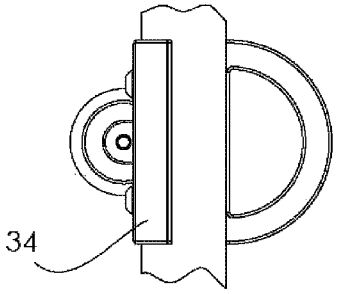
FIG. 19C illustrates a handle, as well as magnet protective cap.
Figure 19:
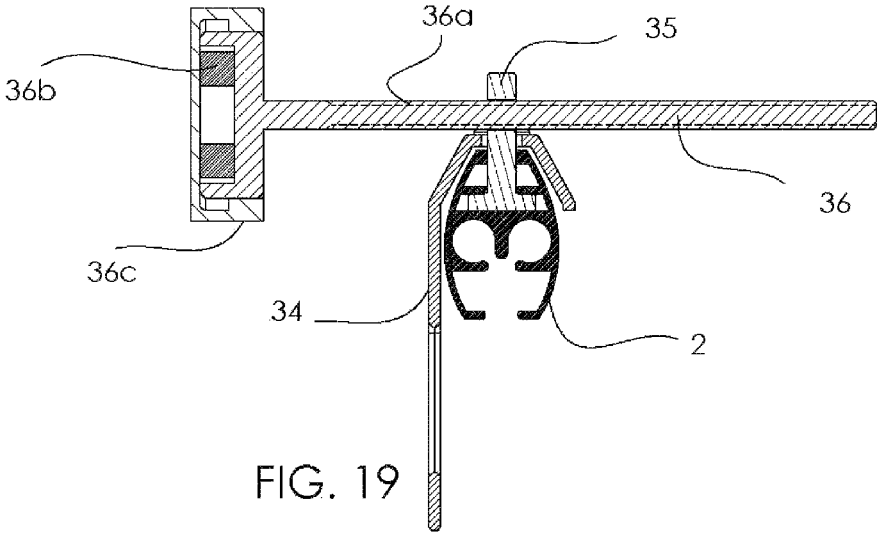
FIG. 19 illustrates a cross-section view of the magnet assembly and handle.

FIG. 19 illustrates a cross-section view of the magnet assembly and handle 34. Magnet mounting slide 35 is attached to rod 2. Magnet mounting slide 35 is configured to slide along the upper or lower track of the elongated rod 2 and be positioned at any point in the elongated rod 2. Magnet mounting slide 35 has a threaded circular opening that complements magnet adjusting thread 36*a*. Adjustable ceramic magnet is generally made from magnet adjusting thread 36*a*, ceramic magnet core 36*b*, and magnet protective cap 36*c*. Threading (or a complementary snap mechanism) of magnet protective cap 36*c* complements threading on magnet adjusting thread 36*a* and protects the ceramic magnet core 36*b* from being exposed to air or moisture to minimize the risk of rusting. The magnet adjusting thread 36*a* has threading which is configured to allow the position of the magnet to be adjusted in relation to magnetic plate 37. The elongated rod 2 closest to the magnetic plate 37 need not be in a precise position for attachment since the position of the ceramic magnet core 36*b* can be adjusted in relation to magnetic plate 37. Also illustrated is handle 34, which is attached to elongated rod 2 via magnet mounting slide 35. The handle 34 extends down elongated rod 2, and faces away from the other elongated rods 2 of the canopy. Depending on the user, none, one, or both of the handle and the magnet can be used.

FIG. 19A is a top view illustrating attachment of handle 34 to the top of elongated rod 2 with fasteners 38. The magnet adjusting thread 36*a* is in a perpendicular position in relation to top of handle 34 that is attached to elongated rod 2. The magnet adjusting thread 36*a* is attached to a loop in magnet mounting slide 35 that sticks out of the opening in handle 34. FIGS. 19B and 19C are front and back views illustrating handle 34, as well as magnet protective cap 36C in FIG. 19B and the back of the magnet adjusting thread 36*a* in FIG. 19C. FIG. 19D is an isometric view illustrating handle 34 attached to elongated rod 2 with fasteners 38. Loop of magnet mounting slide 35 sticks out of opening to which adjusting thread 36*a* is threadably attached. The magnet protective cap 36C is touching magnetic plate 37 which is attached to beam 29 with fasteners 52. A magnetic connection is made between the magnet assembly and beam 29, which the user can terminate by pulling the canopy away with handle 34.

Figure 20C:
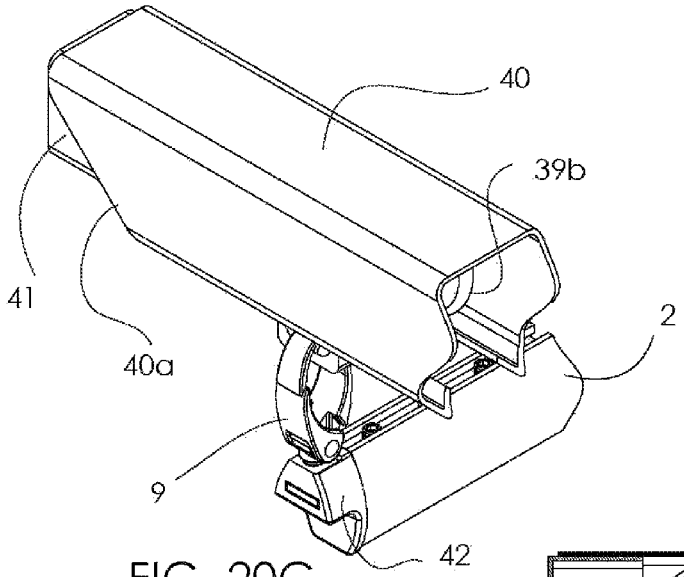
FIG. 20C illustrates elongated rod being rollably attached to roller track through connector.
Figure 20A:
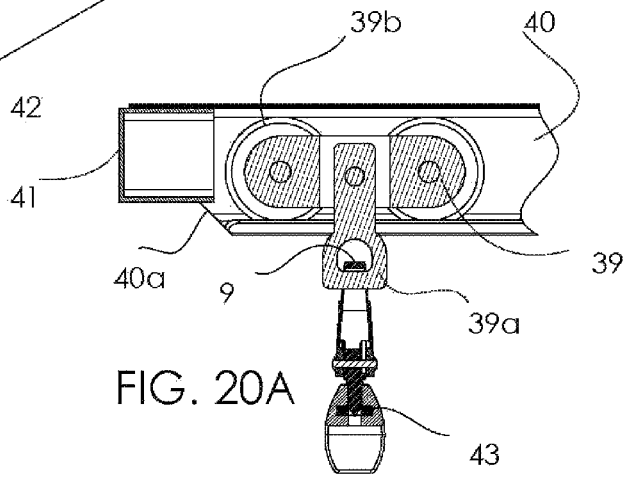
FIG. 20A is a cross section side view of the roller track profile mounting.
Figure 20B:
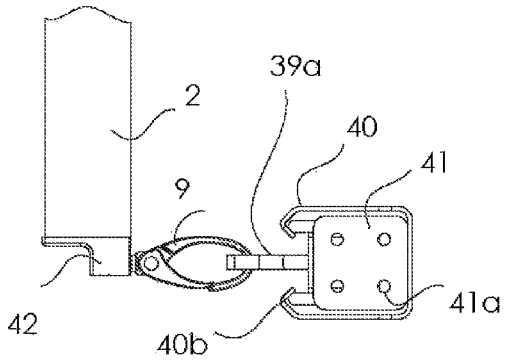
FIG. 20B illustrates elongated rod with connector attached to the connector mounting bracket.
Figure 20:
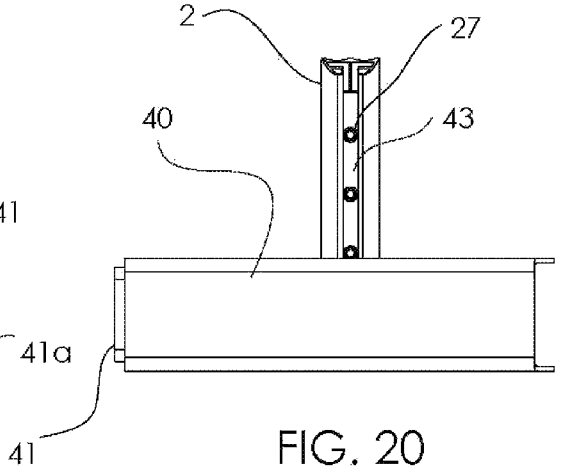
FIG. 20 illustrates roller track profile mounting.

FIG. 20 illustrates the roller track 40 profile mounting. Illustrated is elongated rod 2, threaded fastener 27, roller track 40, roller track mounting bracket 41, and end connector mounting bracket 43. Elongated rod 2 is suspended below track 40. FIG. 20A is a cross section side view of the roller track profile mounting. A. roller carriage 39 is illustrated with rollers 39*b* and roller mounting loop 39*a*. Connector 9 goes around the roller mounting loop 39*a*. Elongated rod 2 is rollably moves along roller track 40 via roller carriage 39. FIG. 20B illustrates elongated rod 2 with connector 9 attached to the connector mounting bracket 42. In this embodiment, connector mounting bracket 42 also acts as an end cap 8. Also illustrated are track roller retainer 40*b*, track mounting bracket 41, and track mounting bracket screw holes 41*a*. Track mounting, bracket screw holes 41*a* are used to attached the track mounting bracket 41 to supporting frame 13. FIG. 20C is an isometric view illustrating elongated rod 2 being rollably attached to roller track 40 through connector 9, which is attached to connector mounting bracket 42. Connector mounting bracket 42 also functions as an end cap 8. Connector 9 goes around roller mounting loop 39*a*. Also illustrated are rollers 39*b*, roller track mounting clearance 40*a*, track mounting bracket 41, and Connector mounting bracket 42.

Figure 21C:
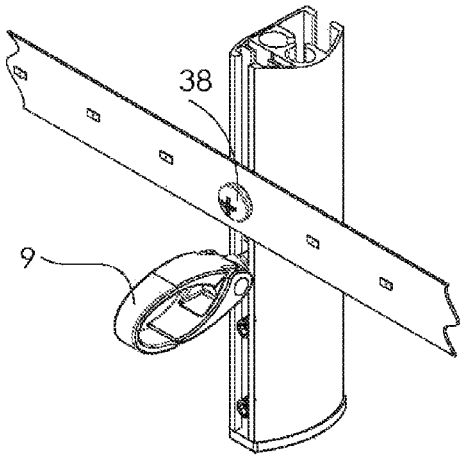
FIG. 21C, the distance control thread is fastened to the top of the elongated rod 2.
Figure 21:
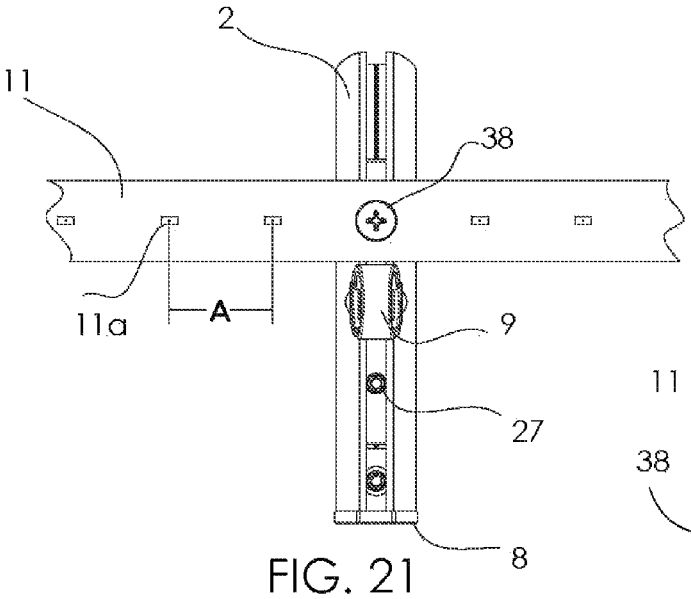
FIG. 21 illustrates the attachment of both connector and distance control thread to the top of the elongated rod.

FIG. 21 illustrates the attachment of both connector 9 and distance control thread 11 to the top of the elongated rod 2. Distance control thread 11 has spaced openings A which are configured to allow adjustment by the user as to how much to restrict the distance of one elongated rod to another. In this illustration, because of the proximity of the distance control thread 11 to connector 9, horizontal bar 26 of connector 9 can be positioned under the distance control thread 11, and the fastener 38 that goes through the opening of distance control thread 11 also goes into the opening of the horizontal bar 26. In this arrangement, fastener 38 also performs the role of fastener 27.

Figure 21A:
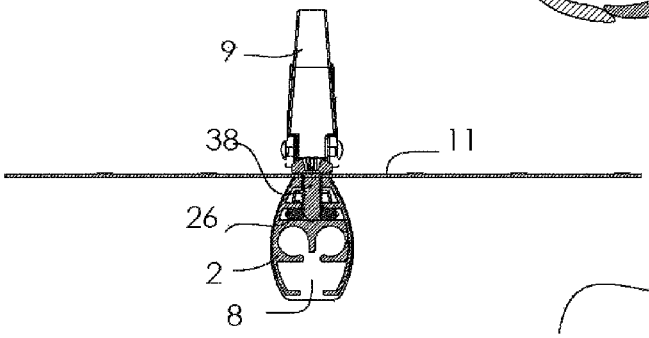
FIG. 21A is a cross-section view illustrating the distance control thread held in place by threaded fastener that is attached to elongated rod.
Figure 21B:
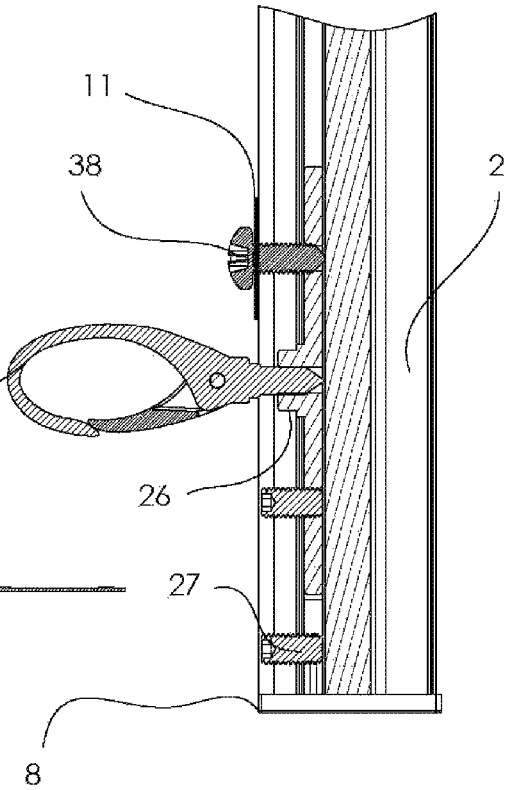
FIG. 21B is a cross-section view illustrating the distance control thread held in place by threaded fastener that is attached to elongated rod.

FIGS. 21A and 21B are a cross-section views illustrating the Distance control thread 11 held in place by threaded fastener 38 that is attached to elongated rod 2. As illustrated in these figures and FIG. 21C, the distance control thread 11 is fastened to the top of the elongated rod 2. A single fattener 38 can go through the opening of distance control thread 11 and the opening of the horizontal bar 26. The Distance control thread 11 can have a plurality of limiting strap marking (equally spaced A) 11*a*, which provide an opening for fastening the distance control thread 11 to elongated rod 2.

Figure 22:
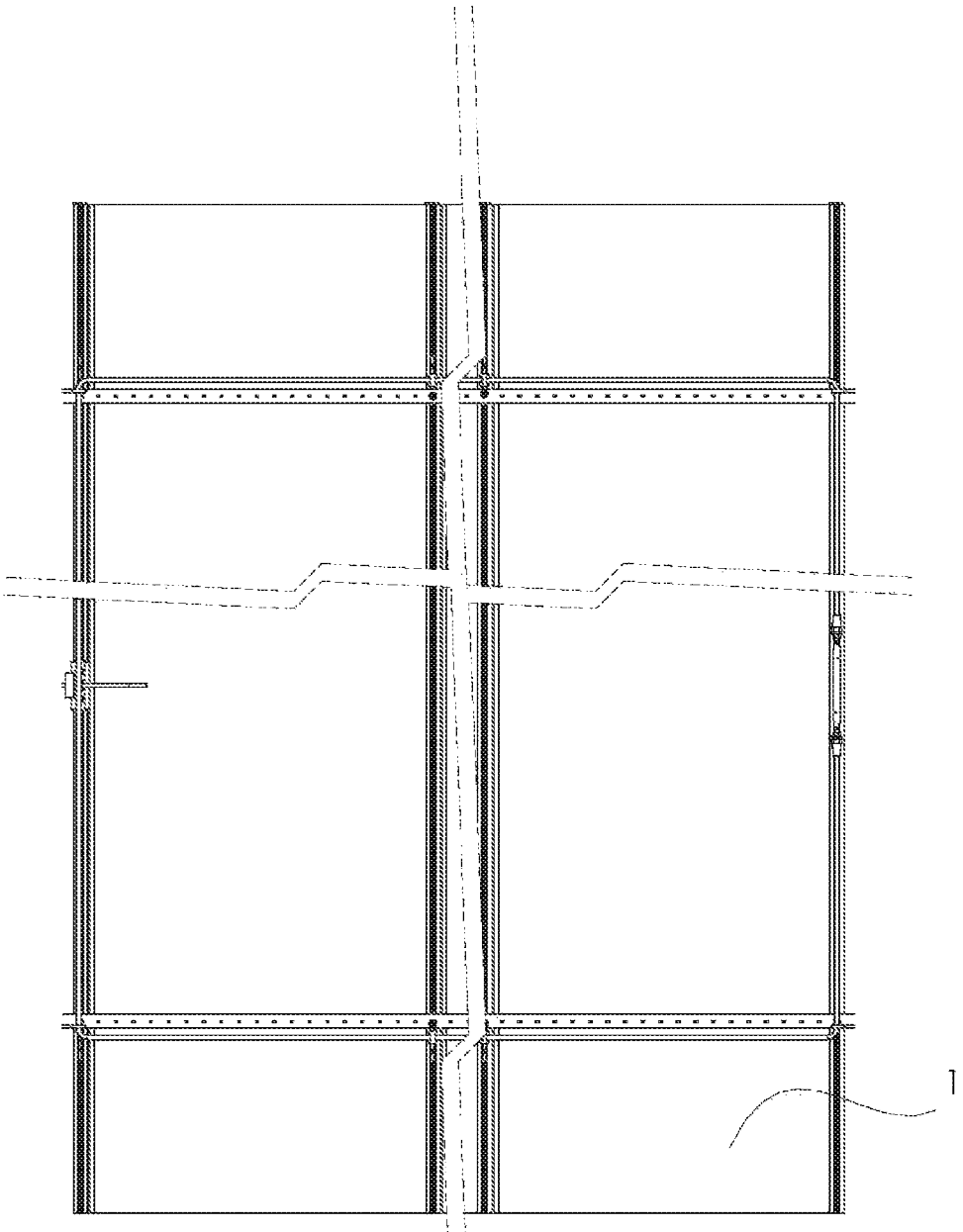
FIG. 22 illustrates a top plan view of the canopy, showing the distance control thread 11 running in a perpendicular direction to the elongated rods which are attached to the edges of the canopy pieces 1.
Figure 22A:
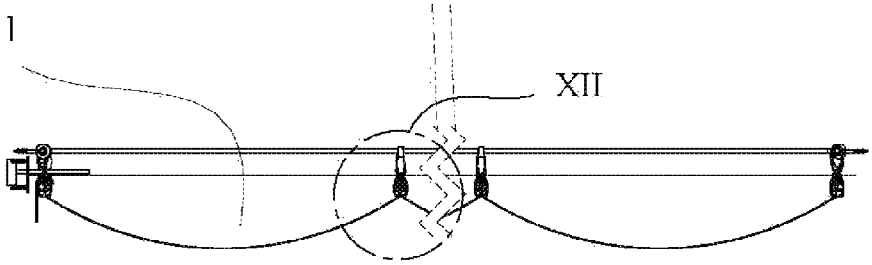
FIG. 22A is a side view illustrating length of the distance control thread being less than the width of canopy piece, thus limiting the distance on how far elongated rods can be moved apart from each other.
Figure 22B:
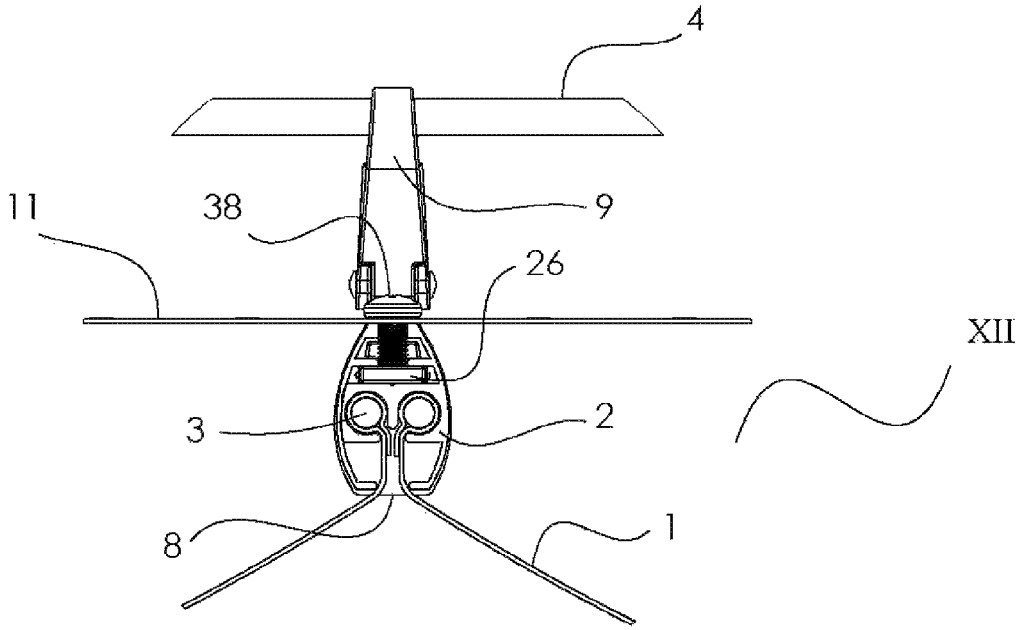
FIG. 22B illustrates canopy pieces attached to the elongated bars, which are placed inside of elongated rods.

FIG. 22 illustrates a top plan view of the canopy, showing the distance control thread 11 running in a perpendicular direction to the elongated rods 2 which are attached to the edges of the canopy pieces 1. FIG. 22A is a side view illustrating length of the distance control thread 11 being less than the width of canopy piece 1, thus limiting the distance on how far elongated rods 2 can be moved apart from each other. FIG. 22B illustrates canopy pieces 1 attached to the elongated bars 3, which are placed inside of elongated rods 2. Horizontal bar 26 is placed inside the track of the elongated bar, and is rotatably attached (through a threaded fastener) to connector 9. Connector 9 is then attached to support 4, resulting in suspension of the canopy from support 4.

Figure 23A:
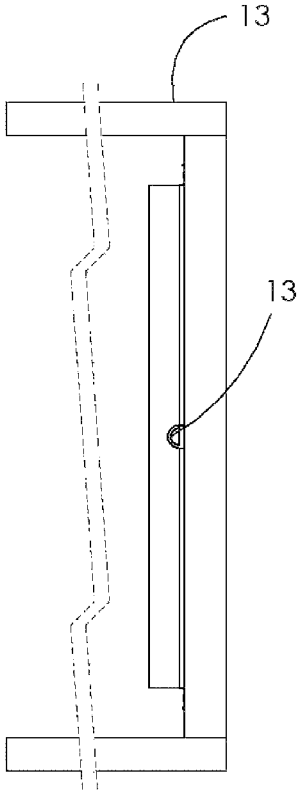
FIG. 23A illustrates a handle, which can be accessed manually to change the position of the canopy.
Figure 23:
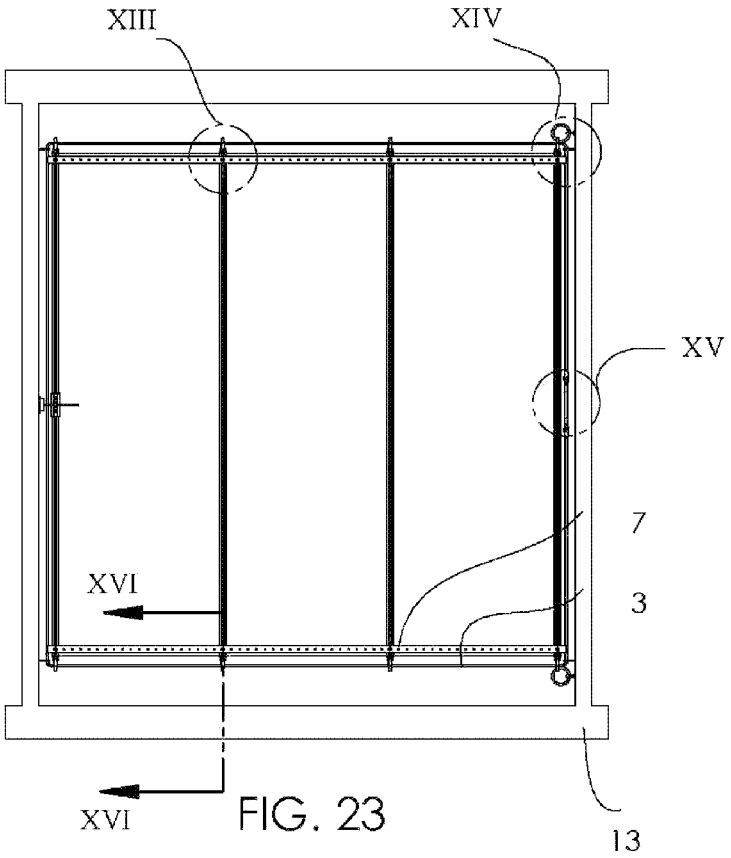
FIG. 23 illustrates a top view of the canopy in an open (deployed) position.
Figure 23B:
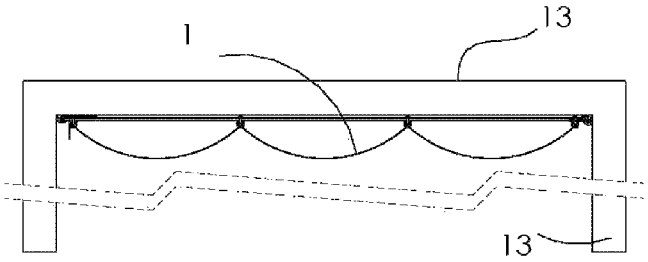
FIG. 23B illustrates connection of canopy pieces to elongated rods.
Figure 23C:
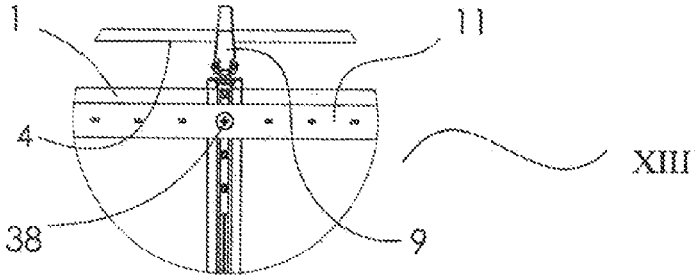
FIG. 23C (corresponding to Roman numeral XIII in FIG. 23) illustrates a distance control thread attached to an elongated rod.
Figure 23D:
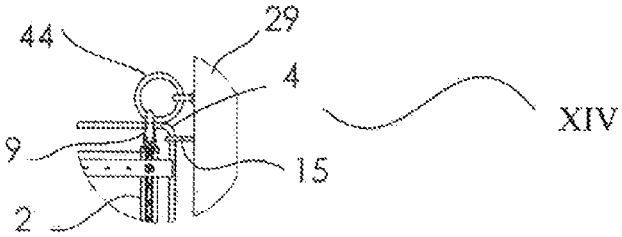
FIG. 23D (corresponding to Roman numeral XIV in FIG. 23) illustrates connection of the ends of's cable wire to each other through a cable wire connector.
Figure 23E:
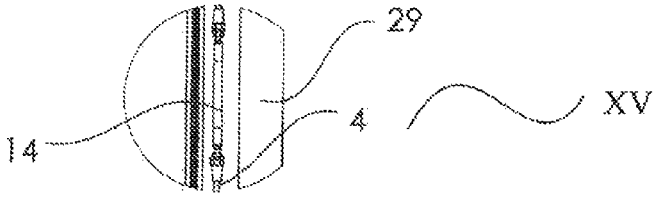
FIG. 23E (corresponding to Roman numeral XV in FIG. 23) illustrates a support (in this case a cable) running through a ring and a connector.
Figure 23F:
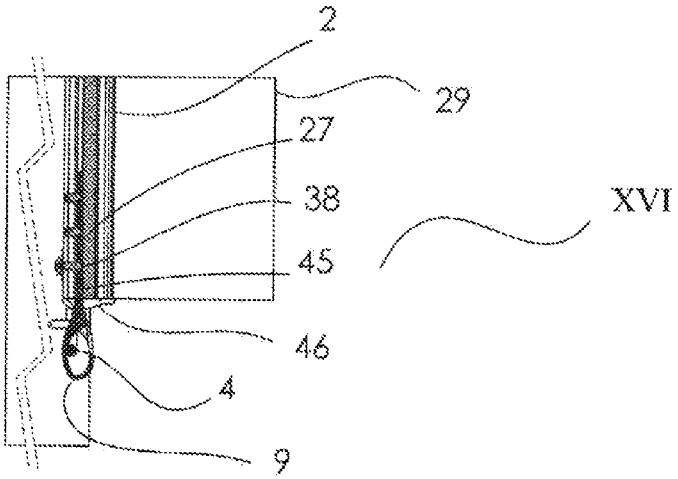
FIG. 23F (corresponding to Roman numeral XVI in FIG. 23) illustrates connector end being attached to the end of elongated rod.

FIG. 23 illustrates a top view of the canopy in an open (deployed) position. The main difference between the canopy illustrated in this figure versus FIG. 16 is that support 9 is attached to the ends of the elongated rods and extends out of the elongated rods at the ends in the same direction as the elongated rods 2. Because the connector does not rise above the elongated rod 2, the elongated rods can be on the same level as support 4, so not requiring additional vertical clearance to install the canopy system by requiring support 4 to be positioned above elongated rod 2. FIG. 23A has the same illustration as FIG. 16B. FIG. 23B has the same illustration as FIG. 16A. FIG. 23D has the same illustration as FIG. 16C. FIGS. 23C, 23E, and 23F illustrate connector end being attached to the end of elongated rod 2. FIG. 23C illustrates Canopy pieces 1, Support 4, Connector 9, distance control thread 11, and cone point mounting screw 38. The fastener 38 can be used to fasten both the distance control thread 11 and connector 9 (through horizontal bar 26) to the elongated rod 2. FIG. 23E illustrates support 4 (in this case a cable) running through ring 15 and connector 9. Connector 9 is attached to end profile retainer eyelet loop 44, which is attached to beam 29. FIG. 23F illustrates connector 9 attached to the end of elongated rod 2. Also illustrated are support 4, beams 29, cone point mounting screw 38, horizontal connector mounting bracket 45, and connector mounting 46.

Figure 25:
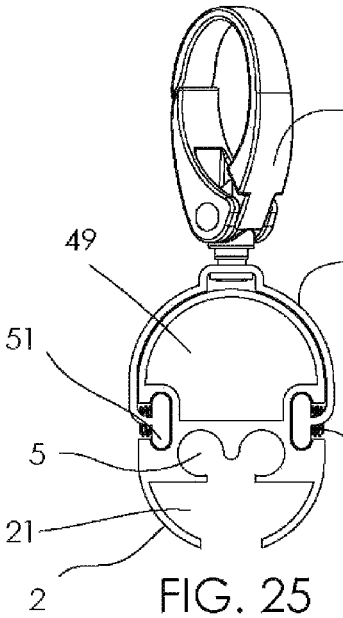
FIG. 25 illustrates a connector slidably attached to a round top elongated rod.
Figure 25A:
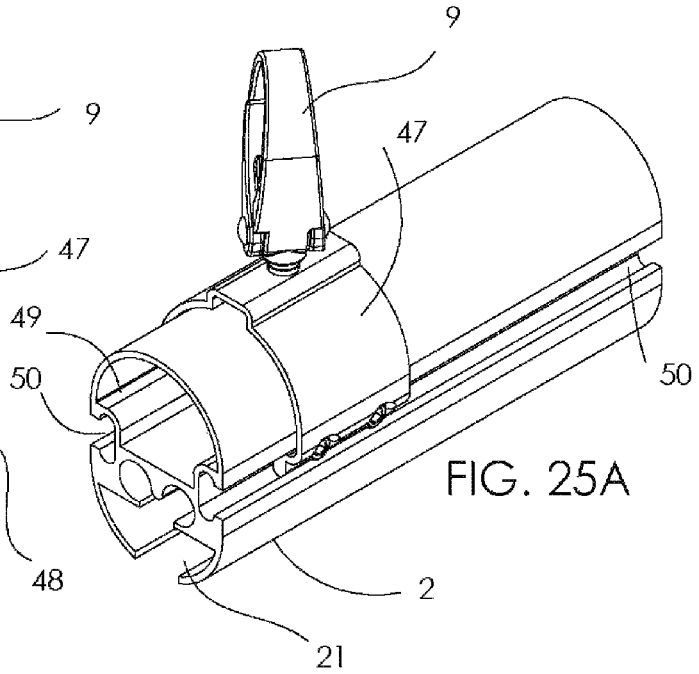
FIG. 25A illustrates a connector slidably attached to a round top elongated rod.
Figure 24:
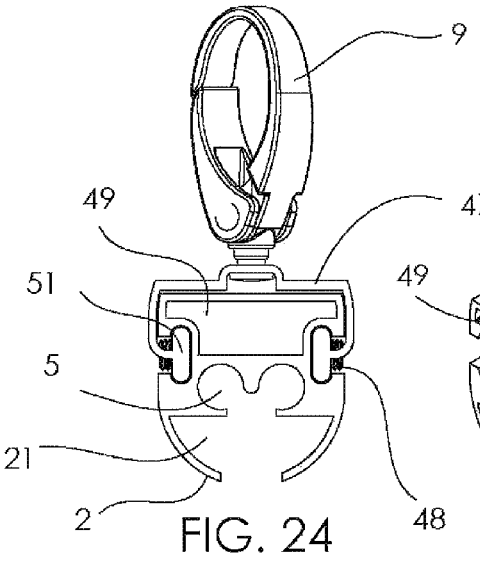
FIG. 24 illustrates a connector slidably attached to a flat top elongated rod.
Figure 24A:
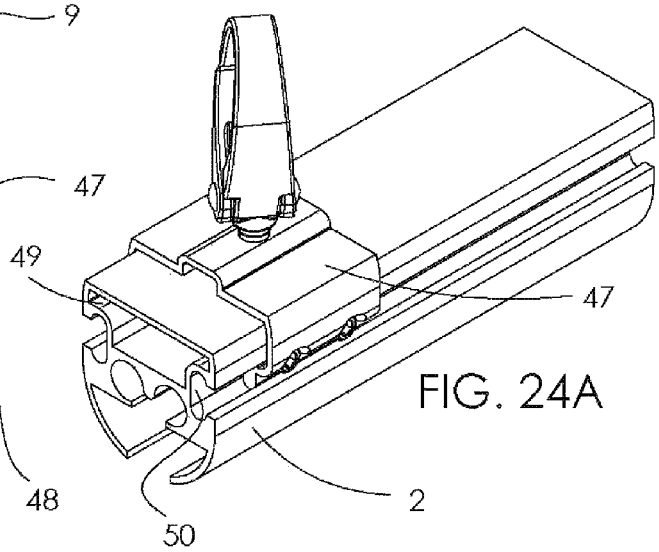
FIG. 24A illustrates a connector slidably attached to a flat top elongated rod.

FIGS. 24 and 25 illustrate connector 9 (in form of a swivel clip) that can be positioned at any point on the elongated rod 2 by sliding external slide 47 along the elongated rod 2. The external slide 47, to which connector 9 is rotatably attached, sits on top of elongated rod as illustrated in FIGS. 23 and 24, and is configured to slide along outside track 50 of elongated rod 2. Track sliders 51 on each side of external slide 47 maintain external slide 47 on top of elongated rod 2. The external slide 47 can be round or flat depending on profile of elongated rod 2. In this embodiment, elongated rod 2 can have an enclosed upper cavity that is separated from the tubular openings 5 of elongated rod 2. Short set screw 203 can be used to fasten the External slide any point along outside track 50 of elongated rod 2.

Figure 26:
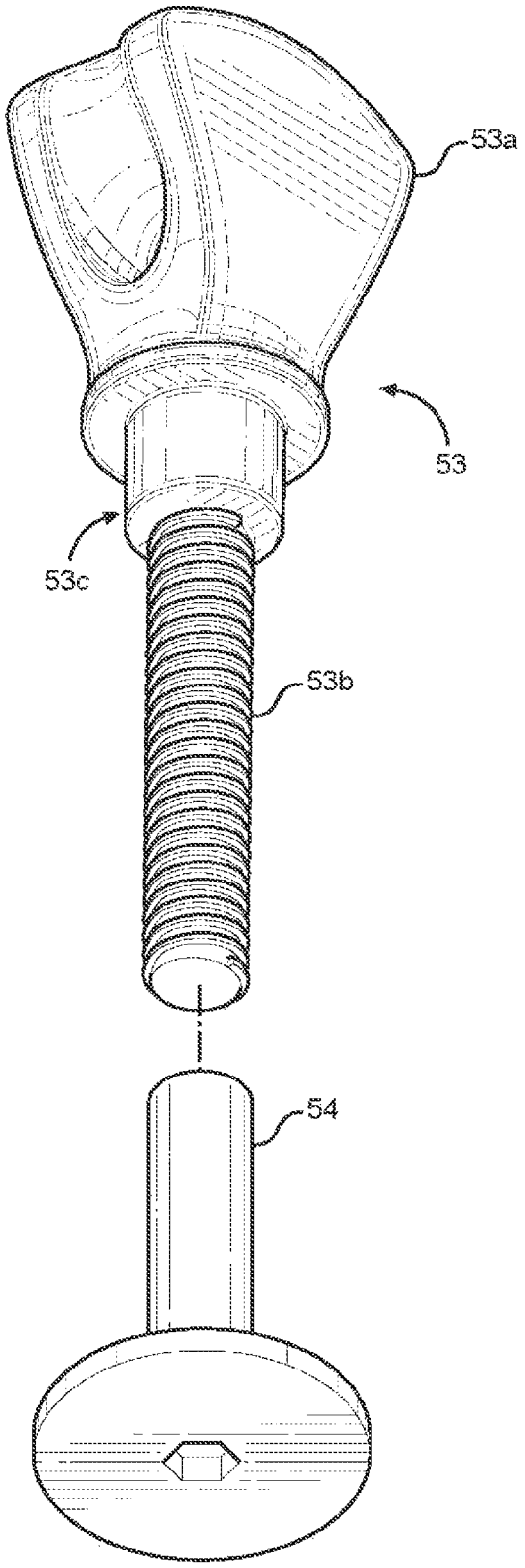
FIG. 26 illustrates a cable support.
Figure 28:
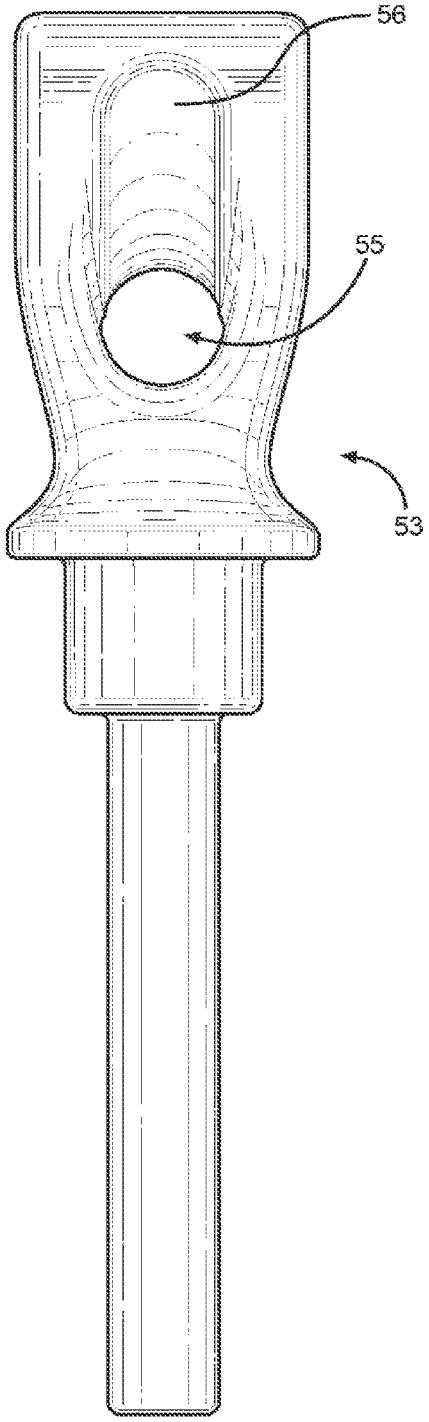
FIG. 28 illustrates a cable support.

FIGS. 26 and 28 illustrate cable support 53. Instead of using ring 15 to attach to support 4, cable support 53 is used. Cable support 53 can be attached to the support by making a hole in the support and attaching the end of the cable support 53 that can have threading to a receiver 54, such as a nut. The receiver 54 can be tightened with an L wrench, Cable support 53 has a head portion 53*a* that is on top of a rod portion 53*b*. The rod portion 53*b* functions for attachment to support 4. The head portion 53*a* has an opening for passage of cable or wire from one side to another. The top of opening inside of the head 53*a* can have a curved portion, typically circular shaped. The circular shape of the top of the opening minimizes damage to the cable overtime, especially when used in corner locations where the cable has to bend. Cable support 53 can also have an optional step 53 in between the head 53*a* and rod 53*b* portions. The step 53*c* can have the same diameter as the portion of the receiver 54 that goes around rod 53*b* so to keep support 4 in place. In some embodiments, the threading of 53*b* alone may be sufficient for securing to support 4 without the need for receiver 54. The rod portion 53*b* and receiver 54 can come in different lengths.

Figure 27:
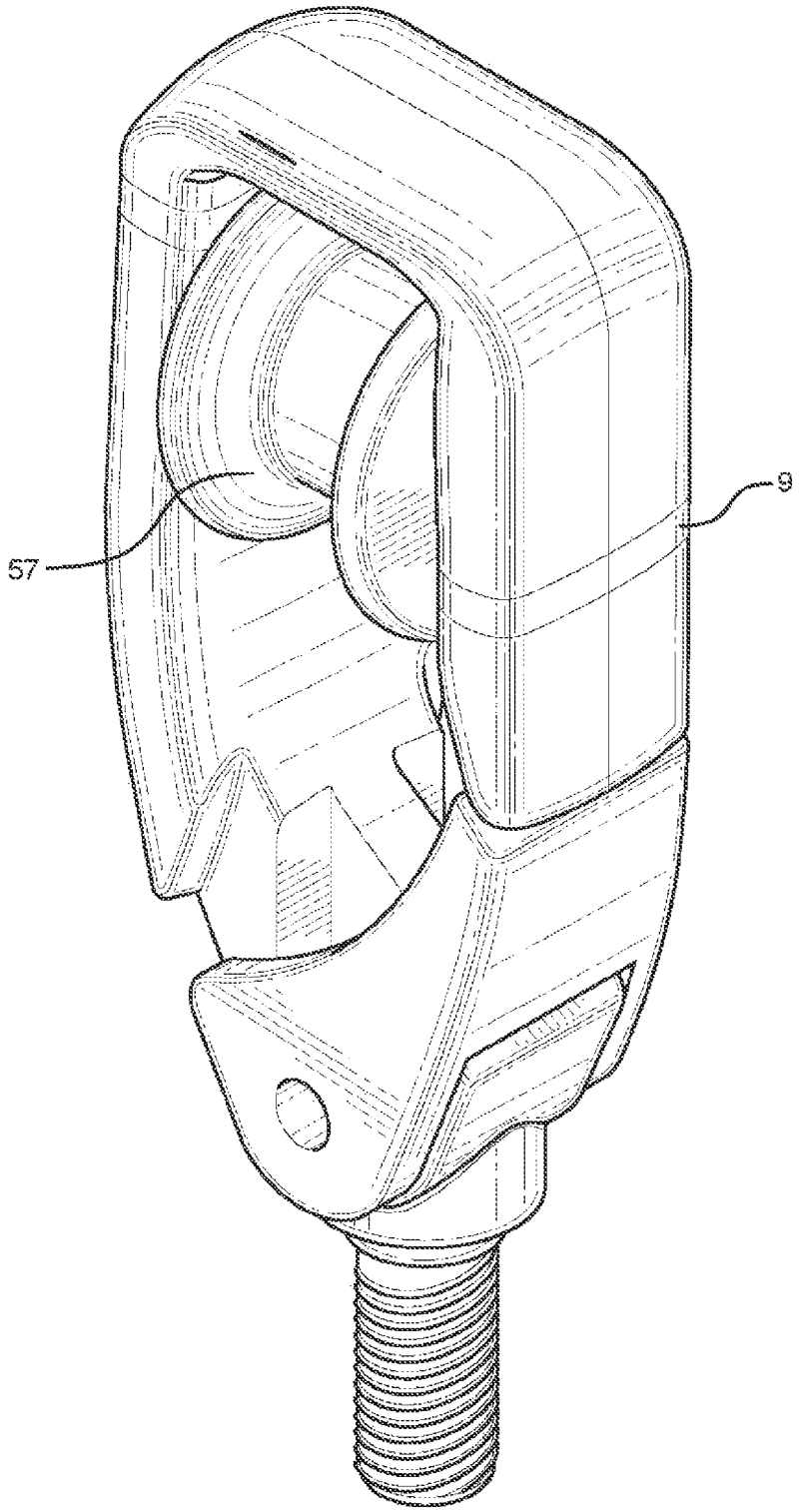
FIG. 27 illustrates a connector with a roller.

FIG. 27 illustrates connector 9 having roller 57. Roller 57 is rollably attached rotatably to connector 9. A cable rides under roller 57. Roller 57 allows for moving connector 9 with ease and minimizes damage to the cable overtime. The threaded portion of connector 9 can be straight ended or pointed, and can be attached to horizontal bar 26 as illustrated in FIG. 4. Roller 57 would press against cable 4 through force of gravity. The connector 9 can have a gate that a user can open to put the cable inside of connector 9. The gate has a spring that keeps it in closed position when it is let go by the user.

REFERENCE NUMBERS

1. Canopy pieces
2. Elongated rods
3. Elongated bars
4. Support
5. Tubular channels
6. Upper cavity
7. Base
8. End cap
9. Connector
10. Lights
11. Distance control thread
11*a*. Limiting strap marking (equally spaced A)
12. Parallel edges
13. Supporting frame

14. Cable wire connector
15. Rings
16. Motor
17. Pulley
18. Supporting base
19. Supporting post
20. Lower cavity
21. Groove
22. Accessory
23. Upper track
24. Lower track
25. Holder
26. Horizontal bar
27. Threaded fasteners
28. Connection mechanism
29. Beams
30. Top material
31. Bottom material
32. Second accessory
34. Handle
35. Magnet mounting slide
36. Adjustable ceramic magnet
36*a*. Magnet adjusting thread
36*b*. Ceramic magnet core
36*c*. Magnet protective cap
37. Magnetic plate
38. Cone point mounting screw (fastener)
39. Roller carriage
39*a*. Roller mounting loop
39*b*. Roller
40. Roller track
40*a*. Roller track mounting bracket clearance
40*b*. Track roller retainer
41. Roller track mounting bracket
41*a*. Track mounting bracket screw hole
42. Connector mounting bracket
43. End connector mounting bracket

What is claimed is:

1. A canopy system comprising:

a. two or more elongated rods positioned parallel to each other, each of the elongated rods having, an enclosed cavity;

b. at least one canopy piece;

c. two or more of elongated bars attached to the at least one canopy piece, each of the elongated bars configured to be held by one of the elongated rods; and d. at least two connection mechanisms, with at least one connection mechanism slidably attached to each of the elongated rods, each of the connection mechanisms having a connector, the connector configured to be suspended from a support and to connect the canopy system to the support, each of the connection mechanisms further configured to slide along tracks on opposites side of the enclosed cavity of the elongated rods and detachably fastened at any location along the elongated rods.

2. The canopy system of claim 1, further comprising the connector having a roller that is configured to rollably rest on the support through force of gravity, wherein the support is in form of a cable.

3. The canopy system of claim 1, further comprising a member with an opening for holding the support in position, wherein the support is in form of a cable.

4. The canopy system of claim 3, wherein the member has a head portion and a rod portion, the head portion having an opening for passage of the support.

5. The canopy system of claim 4, herein the opening has a curved portion that is configured to contact the support.

6. The canopy system of claim 4, wherein the portion that is configured to contact the support is circular.

7. The canopy system of claim 2, wherein each connection mechanism comprises: a) the connector extending upward in a vertical direction from one elongated rod; b) at external slide, the external slide attached to the connector and riding on top of said one elongated rod; c) one or more sliders attached to the external slide; wherein the connector supports the canopy system from the support, and the connector is configured to be moved to any position along of said one elongated rod by moving the external slide along the elongated rod by the sliders sliding through one or more tracks on said one elongated rod.

8. The canopy system of claim 2, wherein the connector is further configured to rotate, allowing the support to run 360 degrees in relation to the elongated rods.

9. A canopy system comprising: a. two or more of elongated rods, the elongated rods positioned parallel to each other; b. at least one canopy piece; c. two or more of elongated bars, each of the elongated bars attached to the at least one canopy piece, each of the elongated bars configured to be held by one of the elongated rods; d. a magnet assembly, the magnet assembly having a magnet, the magnet assembly attached to one of the elongated, rods, the magnet of the magnet assembly configured to form a magnetic connection with an external support structure to maintain the canopy system in a deployed position and wherein the magnet is threadably attached to said one of the elongated rods, the threaded attachment configured to allow the magnet's position to be adjusted in relation to the support structure.

10. The canopy system of claim 9, further comprising the connector having a roller that is configured to rollably rest on the support through force of gravity, wherein the support is in form of a cable.

11. The canopy system of claim 9, further comprising a member with an opening for holding the support in position, wherein the support is in form of a cable.

12. The canopy system of claim 11, further comprising a handle attached to the elongated rod to which the magnet assembly is attached.

13. The canopy system of claim 12, wherein the handle is attached to the elongated rod from top of the elongated rod with fasteners, the handle further extending below the elongated rod.

14. The canopy system of claim 13, further comprising a mounting member attached to the elongated rod, the mounting member having a threaded loop for receiving a magnet adjusting threaded member of the magnet assembly.

15. The canopy system of claim 14, wherein the handle is attached from top of the elongated rod, the handle having an opening configured to allow the threaded loop to rise above the handle from inside of the elongated rod.

16. A canopy system comprising: a) two or more elongated rods, the elongated rods positioned parallel to each other; b) at least one canopy piece; c) two or more of elongated bars, each of the elongated bars attached to the at least one canopy piece, each of the elongated bars configured to be held by one of the elongated rods; and d) a distance control thread attached to the elongated rods in a perpendicular direction, the distance control thread attached from the top of the elongated rods by a fastener that extend into a track.

17. The canopy system of claim 16, further comprising the connector having a roller that is configured to rollably rest on the support through force of gravity, wherein the support is in form of a cable.

18. The canopy system of claim 16, further comprising a member with an opening for holding the support in position, wherein the support is in form of a cable.

19. The canopy system of claim 18, wherein the member has a head portion and a rod portion, the head portion having an opening for passage of the support.

20. The canopy system of claim 19, wherein the opening has a curved portion that is configured to contact the support.

* * * * *